US010502098B2

(12) United States Patent
Mizumi et al.

(10) Patent No.: US 10,502,098 B2
(45) Date of Patent: Dec. 10, 2019

(54) TURBINE ASSEMBLY METHOD

(71) Applicant: Mitsubishi Hitachi Power Systems, Ltd., Yokohama (JP)

(72) Inventors: Shunsuke Mizumi, Yokohama (JP); Juichi Kodera, Yokohama (JP); Koji Ishibashi, Yokohama (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 119 days.

(21) Appl. No.: 15/819,029

(22) Filed: Nov. 21, 2017

(65) Prior Publication Data

US 2018/0142571 A1 May 24, 2018

(30) Foreign Application Priority Data

Nov. 22, 2016 (JP) ..... 2016-226601

(51) Int. Cl.
*F01D 25/24* (2006.01)
*F01D 25/26* (2006.01)

(52) U.S. Cl.
CPC ..... *F01D 25/243* (2013.01); *F01D 25/26* (2013.01); *F05D 2230/644* (2013.01)

(58) Field of Classification Search
CPC ..... Y10T 29/49323; Y10T 29/49778; Y10T 29/4978; Y10T 29/49813; Y10T 29/49815; Y10T 29/49826; Y10T 29/5191; Y10T 29/53; F01D 25/243; F01D 25/285; F01D 25/26; F01D 25/265; F05D 2230/644
See application file for complete search history.

(56) References Cited

U.S. PATENT DOCUMENTS

2002/0082726 A1* 6/2002 Steingraeber ..... F01D 25/285 700/57
2003/0120415 A1* 6/2003 Seeley ..... F01D 17/085 701/100

(Continued)

FOREIGN PATENT DOCUMENTS

JP 6-55385 A 3/1994
JP 2007-32504 A 2/2007
JP 2015-113842 A 6/2015

(Continued)

OTHER PUBLICATIONS

European Search Report issued in counterpart European Application No. 17202796.3 dated Apr. 5, 2018 (nine (9) pages).

(Continued)

*Primary Examiner* — Jason L Vaughan
*Assistant Examiner* — Amanda Kreiling
(74) *Attorney, Agent, or Firm* — Crowell & Moring LLP

(57) ABSTRACT

A turbine assembly method includes a positional information measurement process in which positional information on a plurality of specific portions set on an outer surface of a casing is measured in a state before releasing of bolt fastening of the casing at a time of disassembly of the turbine and in a predetermined disassembly state after the releasing of the bolt fastening, and an alignment process in which positional adjustment of a stationary component with respect to the casing is made based on the measurement results of the positional information on the specific portions in the positional information measurement process.

11 Claims, 9 Drawing Sheets

(56) References Cited

U.S. PATENT DOCUMENTS

| | | | | |
|---|---|---|---|---|
| 2007/0041833 | A1* | 2/2007 | Dupin | F01D 25/265 415/214.1 |
| 2015/0167487 | A1 | 6/2015 | Willett, Jr. et al. | |

FOREIGN PATENT DOCUMENTS

| | | | |
|---|---|---|---|
| KR | 10-2015-0045503 | A | 4/2015 |
| WO | WO 2014/031957 | A1 | 2/2014 |

OTHER PUBLICATIONS

Korean-language Office Action issued in counterpart Korean Application No. 10-2017-0152932 dated Dec. 18, 2018 (four pages).

* cited by examiner

TURBINE ASSEMBLY METHOD

BACKGROUND OF THE INVENTION

1. Field of the Invention

The present invention relates to a turbine assembly method and, more specifically, to a method of assembling a turbine having a structure in which a casing is divided into upper and lower parts which are fastened together by bolts.

2. Description of the Related Art

A turbine such as a steam turbine or a gas turbine includes a turbine rotor as a rotary section and a casing accommodating the turbine rotor. Inside the casing, there are incorporated stationary components such as nozzle diaphragms. From the viewpoint of facility in assembling, the casing, nozzle diaphragms, and the like are divided into upper and lower parts at a horizontal plane. Generally, the casing divided into upper and lower parts has thick-walled plate-like flanges at joint portion of the upper and lower parts, and the upper and lower flanges are fastened to each other by a large number of bolts.

Between the turbine rotor as the rotary section and the nozzle diaphragms and others as the stationary components, there are provided gaps (clearances). In order to prevent the rotary section and the stationary components from coming into contact with each other during operation, and to prevent deterioration in the turbine performance due to an increase in the leakage amount of the working fluid, it is important that the clearances should be set to required intervals. The casing is variously deformed due to the load of parts incorporated into it, the fastening by the bolts, etc. Therefore, in the assembly of the turbine, it is necessary to adjust the position of the stationary components taking into consideration the deformation of the casing beforehand so that the above-mentioned clearances may be the required intervals in the state in which the turbine is finally assembled when they are incorporated into the casing.

In an example of the turbine assembly method, in order to easily obtain adjustment amount of the alignment after the shaft alignment of the casing and to shorten the requisite time for the completion of the turbine by reducing the number of assembly processes, the inner diameter of the inner casing is measured both in an upper part assembly state in which the upper part is mounted to the lower part of the inner casing and in an upper part non-assembly state in which the upper part is not mounted, and the inner diameter difference of the inner casing between both states is obtained. The adjustment amount of the casing shaft alignment is obtained out of various data in the same type of steam turbines with difference data near the obtained inner diameter difference, the lower side of the stationary components is incorporated into the lower part of the inner casing based on the adjustment amount (see, for example, JP-1994-55385-A).

In the steam turbine assembly method disclosed in JP-1994-55385-A, in order to obtain the inner diameter difference of the inner casing between the upper part assembly state and the upper part non-assembly state, it is necessary to temporarily assemble the casing prior to the final assembly of the casing. That is, to adjust the position of the stationary components with high accuracy, it is necessary to perform the process of temporary assembly of the casing and the process of disassembly of the casing after the temporary assembly. That requires more time.

In particular, in the bolt fastening of the casing of a steam turbine or the like, in order to prevent leakage of high temperature and high pressure working fluid such as steam from inside the casing, there is adopted a so-called "thermal shrinking" method. In this case, a lot of time is needed for the assembly operation of the casing. For, in the "thermal shrinking" method, the bolts are temporarily heated to be expanded, and the nuts are engaged with the expanded bolts. After this, the bolts are cooled to press the nuts against the flanges, whereby the flanges are firmly fastened to each other. In this way, in the bolt fastening method by "thermal shrinking," the processes of heating and cooling the bolts are required. In the heating process, it is necessary to heat solely the bolts in as short a time as possible. Therefore, in many cases, a high frequency bolt heater of high performance is employed so that the heat of the heater may not be diffused into the casing. It is necessary, however, to perform the operation of sequentially heating several tens of bolts for each casing, with the heating being performed on one or two bolts at a time. Then the bolts are fastened little by little. Further, each bolt is very large and weighs several tens to one hundred kilograms, and cannot be quickly cooled. Thus, these processes require an enormous amount of time.

In this way, when temporary assembly of the casing is performed in order to make a positional adjustment of high accuracy, the period of the turbine assembly operation is greatly affected. In these circumstances, there is a demand for a reduction of the turbine assembly operation period while maintaining a positional adjustment of high accuracy.

The present invention has been made in order to solve the above problem. It is an object of the present invention to provide a turbine assembly method that can maintain highly accurate positional adjustment of the stationary components with respect to the casing without temporary assembly of the casing.

SUMMARY OF THE INVENTION

The present application includes a plurality of means for solving the above problem. According to one example thereof, there is provided a method of assembling a turbine including a casing divided into a casing lower part and a casing upper part, a turbine rotor contained in the casing, and a stationary component supported inside the casing and divided into a lower side and an upper side. The casing lower part and the casing upper part are connected together by bolt fastening. The method includes a positional information measurement process in which positional information on a plurality of specific portions set on an outer surface of the casing is measured in a state before releasing of bolt fastening of the casing at a time of disassembly of the turbine and in a predetermined disassembly state after the releasing of the bolt fastening, and an alignment process in which positional adjustment of the stationary component with respect to the casing is made based on measurement results in the positional information measurement process.

According to the present invention, positional information on specific portions of the outer surface of the casing is measured in a predetermined disassembly state at the disassembly of the turbine, and positional adjustment of the stationary component with respect to the casing is made based on the measurement results. Accordingly, it is possible to maintain the requisite accuracy in the positional adjustment of the stationary component without temporary assembly of the casing. Thus, it is possible to shorten the process and time of the turbine assembly operation.

The object, configuration, and effect other than those described above will become apparent from the following description of an embodiment.

DESCRIPTION OF THE PREFERRED EMBODIMENTS

In the following, turbine assembly methods according to embodiments of the present invention will be described with reference to the drawings.

Figure 1:
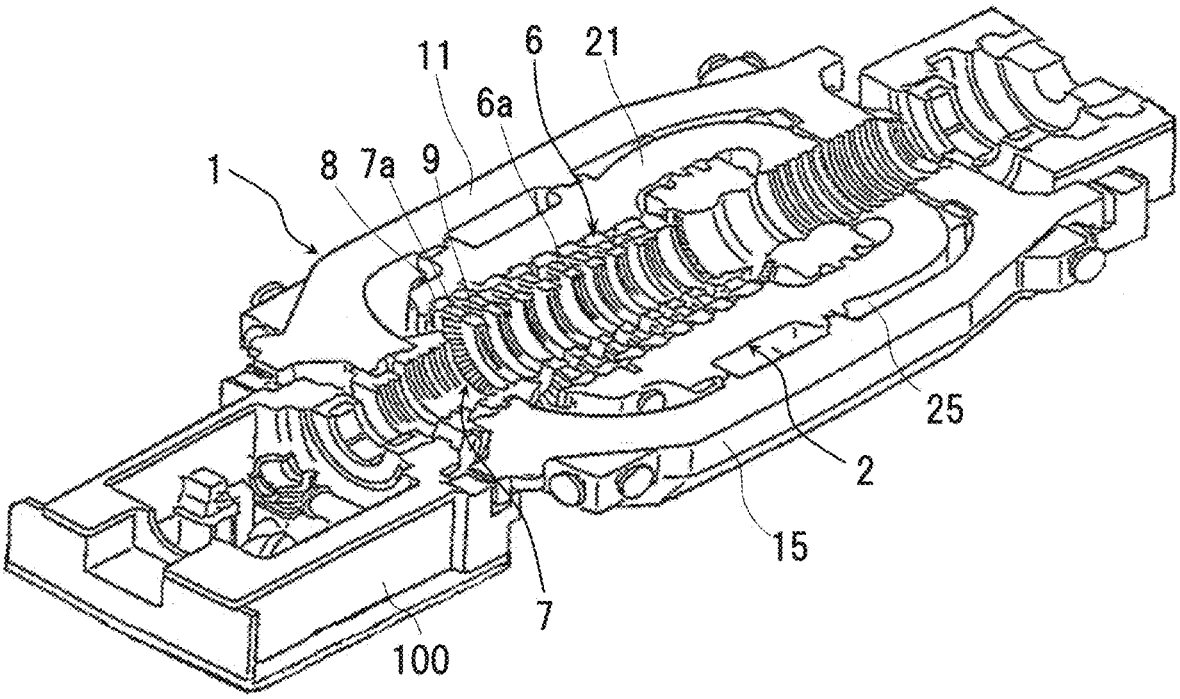
FIG. 1 is a perspective view of a lower side of a steam turbine to which turbine assembly methods according to embodiments of the present invention is applicable.

First, a configuration of a steam turbine to which the turbine assembly methods according to the present invention is applicable will be described with reference to FIGS. 1 and 2. FIG. 1 is a perspective view of a lower side of the steam turbine to which the turbine assembly methods according to the embodiments of the present invention is applicable, and FIG. 2 is a longitudinal sectional view of the steam turbine to which the turbine assembly methods according to the embodiments of the present invention is applicable.

Figure 2:
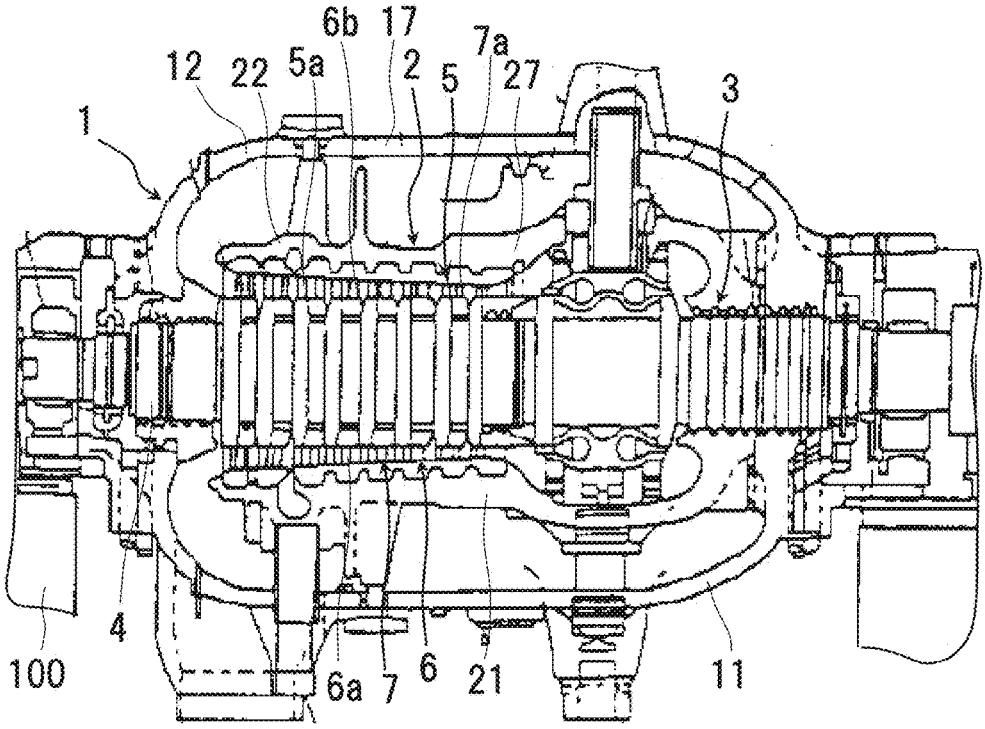
FIG. 2 is a longitudinal sectional view of a steam turbine to which the turbine assembly methods according to the embodiments of the present invention is applicable.

In FIGS. 1 and 2, the steam turbine includes an outer casing 1 supported by a foundation 100, an inner casing 2 contained and supported inside the outer casing 1, and a turbine rotor 3 accommodated in the inner casing 2. The load of the turbine rotor 3 is supported, for example, by the foundation 100.

The outer casing 1 is vertically divided into an outer casing lower part 11 and an outer casing upper part 12 at a horizontal plane. The outer casing lower part 11 and the outer casing upper part 12 each have thick-walled flange portions 15 and 16 (see FIG. 1 and FIG. 9 mentioned below) at joint portion. The outer casing lower part 11 and the outer casing upper part 12 are connected together by bolt fastening in which the flange portions 15 and 16 are firmly fastened to each other by using a plurality of bolts 13 (see FIG. 9) and nuts (not shown). On the inner side of the outer casing 1 and in the vicinity of the flange surface of the flange portion 15, there are provided a plurality of portions (inner casing support portions not shown) supporting the inner casing 2.

The inner casing 2 has a structure similar to that of the outer casing 1. That is, it is vertically divided into an inner casing lower part 21 and an inner casing upper part 22 at a horizontal plane. The inner casing lower part 21 and the inner casing upper part 22 each have thick-walled flange portions 25 and 26 (see FIG. 1 and FIG. 11 mentioned below) at join portion. The inner casing lower part 21 and the inner casing upper part 22 are connected together by bolt fastening in which the flange portions 25 and 26 are firmly fastened to each other by using a plurality of bolts 23 (see FIG. 11) and nuts (not shown). The inner casing 2 is supported by the outer casing 1 via position adjustment members (not shown) allowing thickness adjustment such as shims.

The turbine rotor 3 includes with a rotor shaft 4, and a plurality of moving blade rows 5 arranged at axial intervals in the outer peripheral portion of the rotor shaft 4. Each moving blade row 5 includes a plurality of moving blades **5*a* arranged annularly at peripheral intervals in the outer peripheral portion of the rotor shaft 4**.

Stationary components such as nozzle diaphragms 6 are incorporated into the inner casing 2. Each of the nozzle diaphragms 6 is of an annular configuration, and the nozzle diaphragms 6 are arranged at intervals in the axial direction of the turbine rotor 3. On the inner side of the inner casing 2 and in the vicinity of the flange surface of the flange portion 25, there are provided a plurality of portions (stationary component support portions not shown) supporting the nozzle diaphragms 6. The nozzle diaphragms 6 are supported by the inner casing 2 via position adjustment members allowing thickness adjustment such as shims. Each of the nozzle diaphragms 6 is vertically divided into lower side **6*a* and upper side 6*b* at a horizontal plane. The nozzle diaphragm 6 includes a stationary blade row 7 having a plurality of stationary blades 7***a* arranged annularly at intervals in the peripheral direction of the turbine rotor 3, an annular diaphragm outer ring 8 to which the radial outer tip portions of the stationary blades 7*a* are fixed, and an annular diaphragm inner ring 9 to which the radial inner tip portions of the stationary blades 7*a* are fixed. Each stationary blade row 7 is arranged on the upstream side of each moving blade row 5 and constitutes a stage together with each moving blade row 5. The diaphragm inner ring 9 is provided with seal fins (not shown). Between the seal fins (nozzle diaphragms 6) and the turbine rotor 3, there are provided gaps (clearances).

Figure 3:
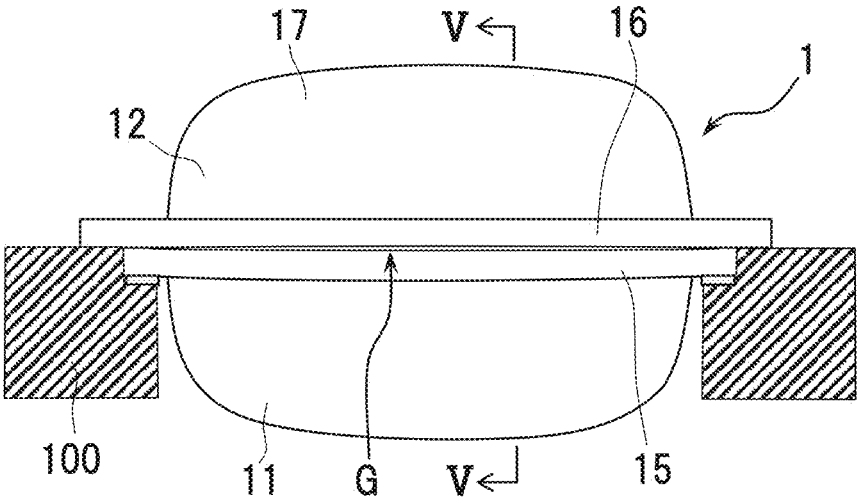
FIG. 3 is an explanatory view showing deformation of an outer casing after years of operation of a steam turbine to which the turbine assembly methods according to the embodiments of the present invention is applicable.
Figure 4:
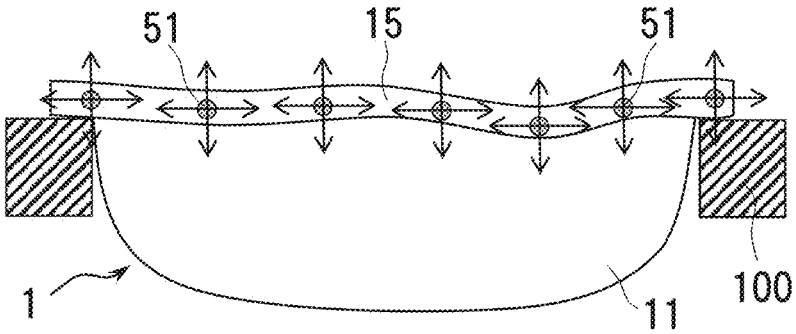
FIG. 4 is an explanatory view showing deformation after years of operation of a flange portion of the outer casing of the steam turbine shown in FIG. 3.
Figure 5:
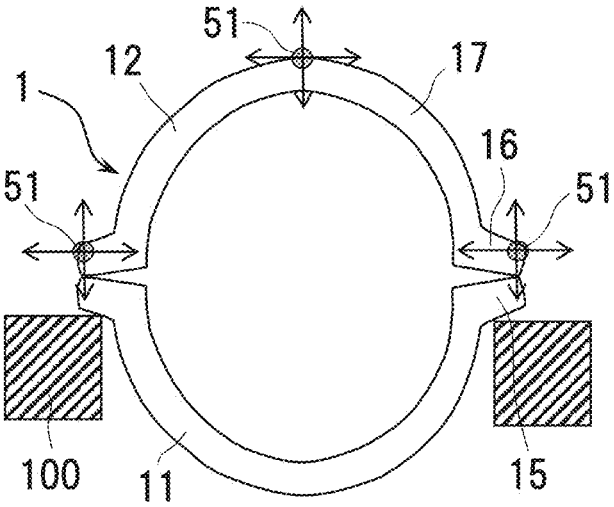
FIG. 5 is a cross-sectional view, taken along arrow line V-V, of the outer casing of the steam turbine shown in FIG. 3.

Next, deformation of the casing at steam turbine disassembly after years of operation will be described with reference to FIGS. 3 through 5. FIG. 3 is an explanatory view showing deformation of the outer casing after years of operation of the steam turbine to which the turbine assembly methods according to the embodiments of the present invention is applicable, FIG. 4 is an explanatory view showing deformation after years of operation of a flange portion of the outer casing of the steam turbine shown in FIG. 3, and FIG. 5 is a cross-sectional view, taken along arrow line V-V, of the outer casing of the steam turbine shown in FIG. 3. In FIGS. 3 through 5, the deformation of the outer casing is shown in an exaggerated manner. In FIGS. 3 through 5, the same portions as those of FIGS. 1 and 2 are indicated by the same reference characters, and a detailed description thereof will be left out.

After long-term operation, the outer casing 1 of the steam turbine is complicatedly deformed mainly due to creep. The lower part 11 and the upper part 12 of the outer casing 1 are firmly fastened together by a plurality of bolts 13 (see FIG. 9) and nuts (not shown). When the bolt fastening is released, a slight gap G is generated between the flange portions 15 and 16 of the lower part 11 and the upper part 12 of the outer casing 1 as shown, for example, in FIG. 3. This gap G is mainly due to deformation of the two flange portions 15 and 16. As shown in FIG. 4, the flange portions 15 and 16 often undergo irregularly wavelike deformation in the vertical direction as seen from the side surface of the outer casing 1. In some cases, the deformation of the flange portions 15 and 16 becomes asymmetrical on the right and left sides. Further, as shown in FIG. 5, with the deformation of the flange portions 15 and 16, the cylindrical shape of the cross section of the outer casing 1 is distorted, and the roundness of the outer casing 1 is degraded. The deformation is of high non-linearity, and it is generally difficult to predict the deformation of the outer casing 1 beforehand with high accuracy.

Similar to the outer casing 1, the inner casing 2 of the steam turbine undergoes complicated deformation of high non-linearity mainly due to creep. Thus, it is generally difficult to predict deformation of the inner casing 2 beforehand. As compared with the above-mentioned deformation, the change in the thickness of the outer casing 1 and the inner casing 2 is minute.

Figure 6:
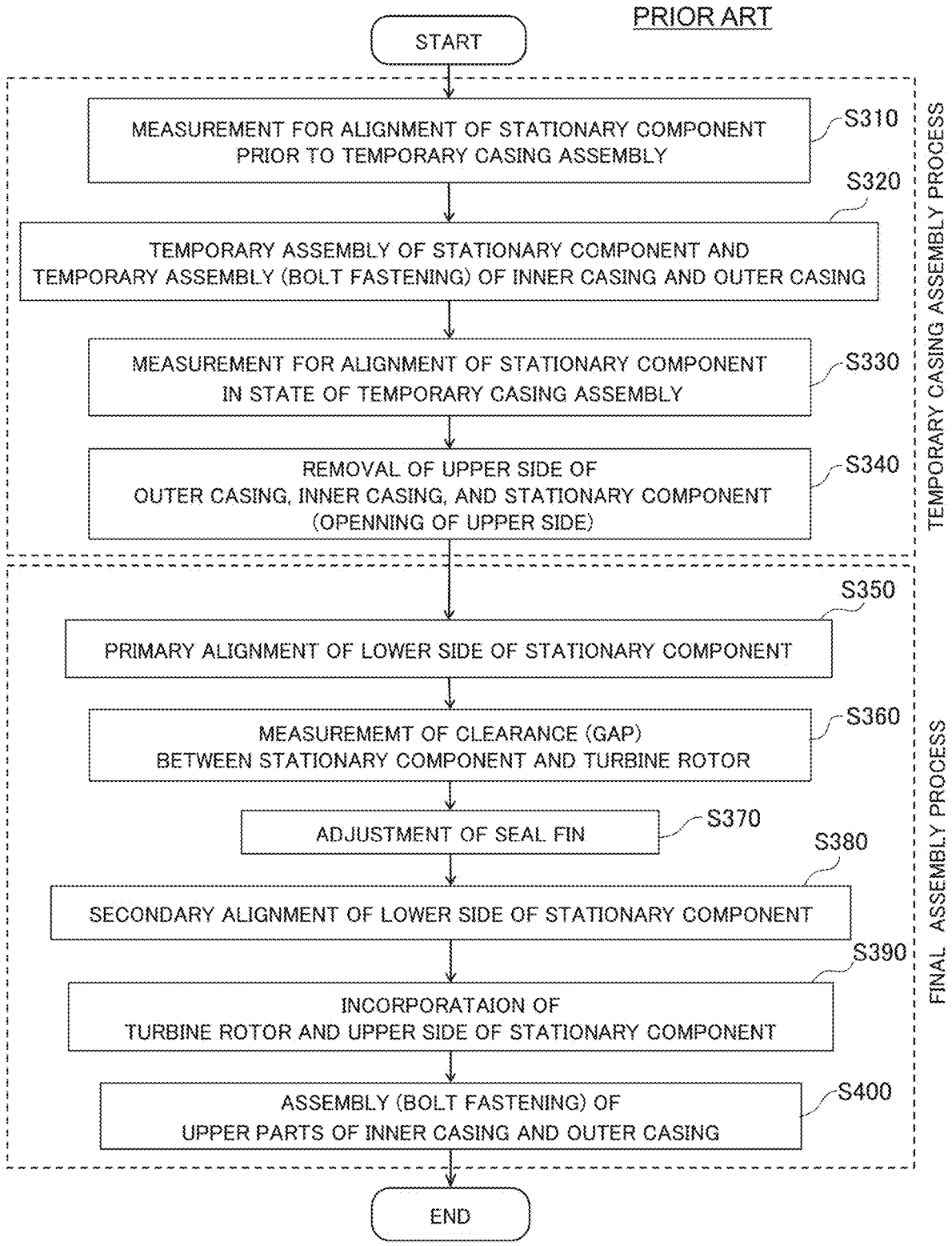
FIG. 6 is a flowchart showing an example of a conventional turbine assembly method as a comparative example of the turbine assembly methods according to the embodiments of the present invention.

Next, a conventional steam turbine assembly method will be described with reference to FIG. 6. FIG. 6 is a flowchart showing an example of the conventional steam turbine assembly method as a comparative example of the turbine assembly methods according to the embodiments of the present invention.

After long-term operation, the steam turbine is disassembled for overhauling, reconstruction, etc., and is assembled again. At the time of reassembly of the steam turbine, to make the gaps (clearances) between the turbine rotor 3 (see FIG. 2) and the stationary components such as the nozzle diaphragms 6 (see FIG. 1) required intervals, it is necessary to perform positional adjustment (the alignment) of the stationary components with respect to the inner casing 2 (see FIGS. 1 and 2) with high accuracy. As described above, however, the outer casing 1 and the inner casing 2 of the steam turbine after long-term operation can undergo deformation that is hard to predict. That is, when the upper parts 12 and 22 of the outer casing 1 and the inner casing 2 are mounted to the lower parts 11 and 21 and fastened by bolts, the outer casing 1 and the inner casing 2 are deformed, and displacements that are hard to predict may be generated in the stationary components mounted to the inner casing 2. In this case, it can happen that the clearances between the turbine rotor 3 and the stationary components are deviated from the required values.

In view of this, in the conventional steam turbine assembly method, in order to align with high accuracy, there is grasped a difference in positional relationship of the stationary components (displacement information such as displacement amount of the stationary components and displacement direction) between a state in which the outer casing upper part 12, the inner casing upper part 22, and the upper side of the stationary components have been mounted (upper part assembled state or tops-on state) and a state in which the outer casing upper part 12, the inner casing upper part 22, and the upper side of the stationary components have not been mounted yet (upper part unassembled state of or tops-off state), and the positions of the stationary components are adjusted taking the difference (displacement information) into consideration.

For example, as shown in FIG. 6, temporary assembly of the casing is first performed, and information on the positional relationship of the stationary components before and after the casing temporary assembly is measured, whereby the displacement information on the stationary components due to the temporary assembly of the casing is grasped (step S310 through step S340). After this, the positional adjustment of the stationary components with respect to the casing (the alignment of the stationary components) is conducted taking into consideration the measurement results before and after the temporary assembly, and the final assembly of the casing is conducted (step S350 through step S400).

In the casing temporary assembly process, measurement for the alignment of the stationary components is first conducted in the state in which the lower side of the stationary components such as the nozzle diaphragms 6 is incorporated into the lower part 21 of the inner casing 2 (the state before the temporary assembly of the casing) (step S310). More specifically, distances between a virtual axis of a piano wire, laser beam, or the like and the stationary components are measured by using a micrometer, laser detector, or the like. Measurement points of each stationary component are, for example, both right and left portions and a lower side portion on the inner peripheral surface of the nozzle diaphragm 6. Through this measurement, it is possible to obtain information on the positional relationship of the stationary component before the temporary assembly of the casing (the distances between the virtual axis and the predetermined portions of the stationary component).

Next, the stationary components, the inner casing 2, and the outer casing 1 are temporarily assembled (step S320), and the assembly state of the steam turbine is simulated. More specifically, the upper side of the stationary components is mounted to the lower side thereof to temporarily assemble the stationary components. At this time, the incorporation of the turbine rotor 3 is not performed. Subsequently, the upper part 22 of the inner casing 2 is placed on the lower part 21, and the upper part 22 and the lower part 21 are fastened together by bolts to temporarily assemble the inner casing 2. After this, the upper part 12 of the outer casing 1 is placed on the lower part 11, and the upper part 12 and the lower part 11 are fastened together by bolts to temporarily assemble the outer casing 1.

Subsequently, in the temporary assembly state of the inner casing 2 and the outer casing 1, there is conducted measurement for the alignment of the stationary components (step S330). More specifically, as in step S310, the distances between the virtual axis and the predetermined portions of the stationary components are measured. Based on the measurement results in the casing temporary assembly state in step S330 and the measurement results before the casing temporary assembly state in step S310, it is possible to obtain displacement information on the stationary components such as the displacement amount and the displacement direction due to the temporary assembly of the inner casing 2 and the outer casing 1.

After this, the outer casing upper part 12, the inner casing upper part 22, and the upper side of the stationary components temporarily assembled are removed (step S340), and the upper side of the steam turbine is opened.

Next, in the final assembly process, there is first conducted primary alignment of the lower side of the stationary components (step S350). More specifically, taking into consideration the displacement information of the stationary components due to the temporary assembly of the inner casing 2 and the outer casing 1 obtained based on the measurement results in step S310 and step S330, positional adjustment of the lower side of the stationary components with respect to the inner casing 2 is performed by adjusting the thickness of the position adjustment members such as shims. That is, each stationary component is previously moved in a direction opposite to the displacement information on the stationary component obtained from the measurement results, whereby the displacement of the stationary component due to the assembly of the inner casing 2 and the outer casing 1 is offset.

Next, the clearances (gaps) between the turbine rotor 3 and the aligned stationary components are measured (step S360). More specifically, in the state in which the lower side of the stationary components such as the nozzle diaphragms 6 is aligned with respect to the inner casing lower part 21, lead wires are previously arranged in the regions in which the clearances are to be measured, for example, of the seal fins of the turbine rotor 3 and the stationary components. With the lead wires installed, the turbine rotor 3 is incorporated into the lower side of the stationary components. At this time, the lead wires are crushed except for the gap portion between the turbine rotor 3 and the stationary components. The lead wires are extracted, and the thickness of the portions of the lead wires left uncrushed is measured. The remaining portions correspond to the clearances between the stationary components and the turbine rotor 3. As a result, it is possible to accurately measure the clearances between the stationary components and the turbine rotor 3. In step S360, the clearances are measured in the state in which the upper side of the stationary components is incorporated as needed.

Next, based on the accurate clearances measured in step S360, fine adjustment of the clearances is conducted. More specifically, based on the measurement results in step S360, there is performed fine adjustment of the height, etc. of the seal fins provided on the turbine rotor 3 and the stationary components such as the nozzle diaphragms 6 (step S370). Subsequently, fine positional adjustment of the lower side of the stationary components with respect to the inner casing 2 (secondary alignment) is conducted based on the measurement results in step S360 (step S380).

After this, the turbine rotor 3 and the upper side of the stationary components are incorporated (step S390). Finally, the upper part 22 of the inner casing 2 is placed on the lower part 21, and the upper part 22 and the lower part 21 are fastened together by bolts. Then, the upper part 12 of the outer casing 1 is placed on the lower part 11, and the upper part 12 and the lower part 11 are fastened together by bolts (step S400).

In this way, in the conventional steam turbine assembly method, when the lower side of the stationary components is incorporated into the inner casing lower part 21, alignment is performed taking into consideration the final assembly state, so that the adjustment of high accuracy is possible.

However, in this conventional assembly method, to perform highly accurate alignment, it is necessary to temporarily assemble the outer casing 1 and the inner casing 2. Thus, the bolt fastenings of the outer casing 1 and the inner casing 2 must be each performed two times, resulting in a long-term assembly operation. In the bolt fastening of the outer casing 1 and the inner casing 2, in order that steam may not leak from between the mating surfaces of the lower parts 11 and 21 and the upper parts 12 and 22, there is employed a so-called "thermal shrinking" method. In the "thermal shrinking" method, the bolts 13 and 23 (see FIGS. 9 and 11), are temporarily heated to be expanded, and the nuts are engaged with the expanded bolts 13 and 23. After this, the bolts 13 and 23 are cooled, whereby the nuts are pressed against the flange portions 15, 16, 25, and 26 (see FIGS. 9 and 11) to firmly fasten the flange portions 15, 16, 25, and 26 to each other. In this way, in the bolt fastening method by "thermal shrinking," it is necessary to perform a heating process and a cooling process on the bolts 13 and 23. In the heating process, it is necessary to heat solely the bolts in as short a time as possible. Therefore, a high frequency bolt heater with high performance is often used so that the heat of the heater may not be diffused into the casing. However, it is necessary to perform the operation of sequentially heating several tens of bolts for each casing, with the heating being performed on one or two bolts at a time. Then the bolts are fastened little by little. Further, each bolt is very large and weighs several tens to one hundred kilograms, and cannot be quickly cooled in the cooling process. Thus, these processes require an enormous amount of time.

First Embodiment

Figure 7:
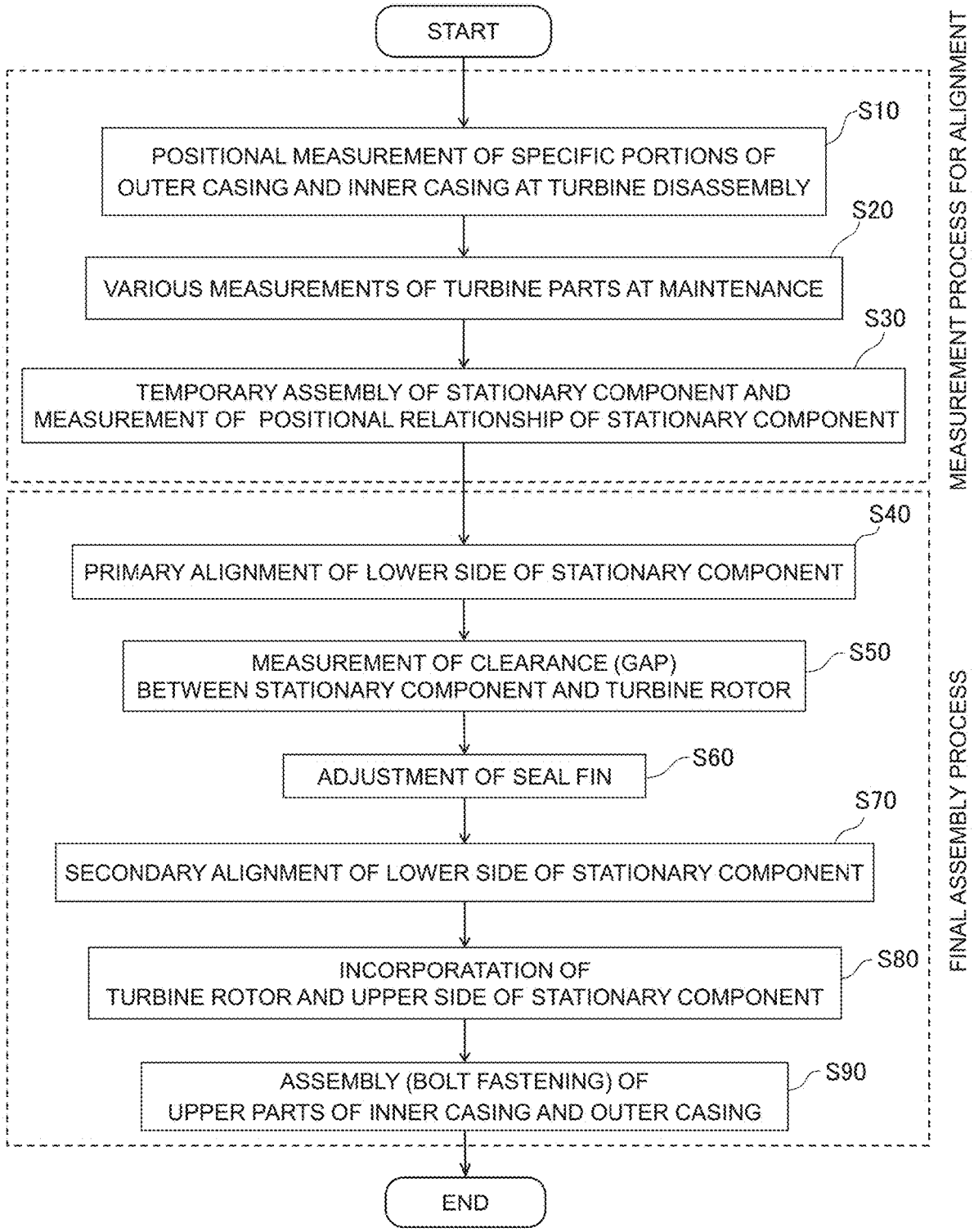
FIG. 7 is a flowchart illustrating a turbine assembly method according to a first embodiment of the present invention.

Next, a turbine assembly method according to a first embodiment of the present invention will be described with reference to FIG. 7. FIG. 7 is a flowchart illustrating the turbine assembly method according to the first embodiment of the present invention.

In summary, in the turbine assembly method according to the first embodiment of the present invention, positional information on specific portions of the outer surface of the casing is measured in a plurality of predetermined disassembly state at the time of disassembly of the steam turbine, and positional adjustment of the stationary components with respect to the casing (alignment) is conducted based on the measurement results. In a plurality of different disassembly states of the steam turbine, positional information on the specific portions of the casing is measured, whereby it is possible to grasp the deformation information before and after the assembly (disassembly) of the casing. The alignment of the stationary components is conducted by utilizing the deformation information before and after the assembly (disassembly) of the casing, whereby it is possible to perform the alignment without temporary assembly of the casing with high accuracy equivalent to that of the conventional steam turbine assembly method having a casing temporary assembly process. The method will be specifically described below.

After a long-term operation, the steam turbine is disassembled for the purpose of overhauling, reconstruction and the like. At this time, as shown in FIG. 7, for each step of disassembly state of each part of the steam turbine, positional information (three-dimensional positional coordinates) of specific portions (see FIGS. 9 and 11) of the outer surface of the outer casing 1 and the inner casing 2 is measured (step S10). Based on the positional information of the specific portions 51 measured in a plurality of disassembly states in step S10, it is possible to obtain deformation information at the time of disassembly of the outer casing 1 and the inner casing 2. From the deformation information at the disassembly of the outer casing 1 and the inner casing 2, it is possible to estimate with high accuracy the deformation information at the assembly thereof. In view of this, the measurement results of the positional information (the deformation information at the assembly of the outer casing 1 and the inner casing 2) are used when evaluating the adjustment amount of the alignment of the lower side of the stationary components in the subsequent step described below. The positional information measurement method will be described in detail below.

After the completion of the disassembly of the steam turbine, each portion of the steam turbine is maintained. At the maintenance, in addition to the measurement of the inspection items, various measurements of the turbine parts useful in evaluating the adjustment amount of the alignment are simultaneously conducted (step S20). For example, the height of the seal fins, etc. is measured.

Next, with respect to the lower part 21 of the inner casing 2 supported by the outer casing lower part 11, temporary assembly of the stationary components such as the nozzle diaphragms 6 (see FIGS. 1 and 2) is conducted, and, at the same time, information on positional relationship of the stationary components is measured (step S30). More specifically, as in step S310 of the conventional steam turbine assembly method, in the state in which the lower side of the stationary components such as the nozzle diaphragms 6 is incorporated into the lower part 21 of the inner casing (in the state prior to the temporary assembly of the stationary components), the distances between the virtual axis and the predetermined portions of the stationary components (information on the positional relationship of the stationary components) are measured. After the measurement, the upper side of the stationary components is mounted to the lower side to perform the temporary assembly. As in the case of the measurement before the temporary assembly, in the temporary assembly state of the stationary components, the distances between the virtual axis and the predetermined portions of the stationary components are measured. From the measurement results in the temporary assembly state of the stationary components and the measurement results prior to the temporary assembly thereof, deformation information due to the temporary assembly of the stationary components is obtained. The deformation information due to the temporary assembly of the stationary components is used when evaluating the adjustment amount of the alignment of the lower side of the stationary components in the subsequent step described below. The measurement results in step S30 are obtained in the state in which solely the stationary components are temporarily assembled, and are not the measurement result obtained in the state in which the outer casing 1 and the inner casing 2 are finally assembled by bolt fastening.

After this, without temporarily assembling the inner casing 2 and the outer casing 1, the final assembly of the inner casing 2 and the outer casing 1 is conducted. More specifically, first, based on the measurement results of the positional information on the specific portions 51 of the outer casing 1 and the inner casing 2 in step S10 and the measurement results of the information on the positional relationship of the stationary components in step S30, there is performed the primary alignment of the lower side of the stationary components (step S40). That is, by utilizing the deformation information before and after the assembly of the inner casing 2 and the outer casing 1 based on the measurement results in step S10 and the deformation information before and after the assembly of the stationary component based on the measurement results in step S30, the displacement information on the stationary components in the final assembly state is evaluated. As a result, it is possible to obtain the adjustment amount of the alignment. The adjustment method of the primary alignment will be described in detail with the detail description of the positional information measurement method described below.

Next, the clearances (gaps) between the turbine rotor 3 and the aligned stationary components are measured (step S50). More specifically, as in the case of step S360 in the conventional steam turbine assembly method, in the state in which the lower side of the stationary components such as the nozzle diaphragms 6 is aligned with respect to the inner casing lower part 21, lead wires are arranged beforehand at the portions where the clearance measurement is to be conducted. With the lead wires installed, the turbine rotor 3 is incorporated into the lower side of the stationary components, and the thicknesses of the portions where the lead wires are left uncrushed, that is, the clearances, are measured.

Next, based on the clearances measured in step S50, fine adjustment is conducted on the clearances between the stationary components and the turbine rotor 3. More specifically, fine adjustment of the height, etc. of the seal fins of the nozzle diaphragms 6, the turbine rotor 3, and others is conducted based on the measurement result in step S50 (step S60). Subsequently, fine adjustment of the position of the lower side of the stationary components with respect to the inner casing 2 (secondary alignment) is performed based on the measurement result in step S50 (step S70).

After the fine adjustment on the clearances, the turbine rotor 3 and the upper side of the stationary components are incorporated (step S80). Finally, the upper part 22 of the inner casing 2 is placed on the lower part 21, and the upper part 22 and the lower part 21 are fastened together by bolts. The upper part 12 of the outer casing 1 is placed on the lower part 11, and the upper part 12 and the lower part 11 are fastened by bolts (step S90). As a result, the final assembly operation for the inner casing 2 and the outer casing 1 is completed.

In this way, in the present embodiment, the stationary components are aligned without the temporary assembly of the outer casing 1 and the inner casing 2, so that it is possible to shorten the process and time of the steam turbine assembly operation.

Next, a method of measuring positional information of the casing at the turbine disassembly in the turbine assembly method according to the first embodiment of the present invention will be described in detail with reference to FIGS. 8 through 13.

Figure 8:
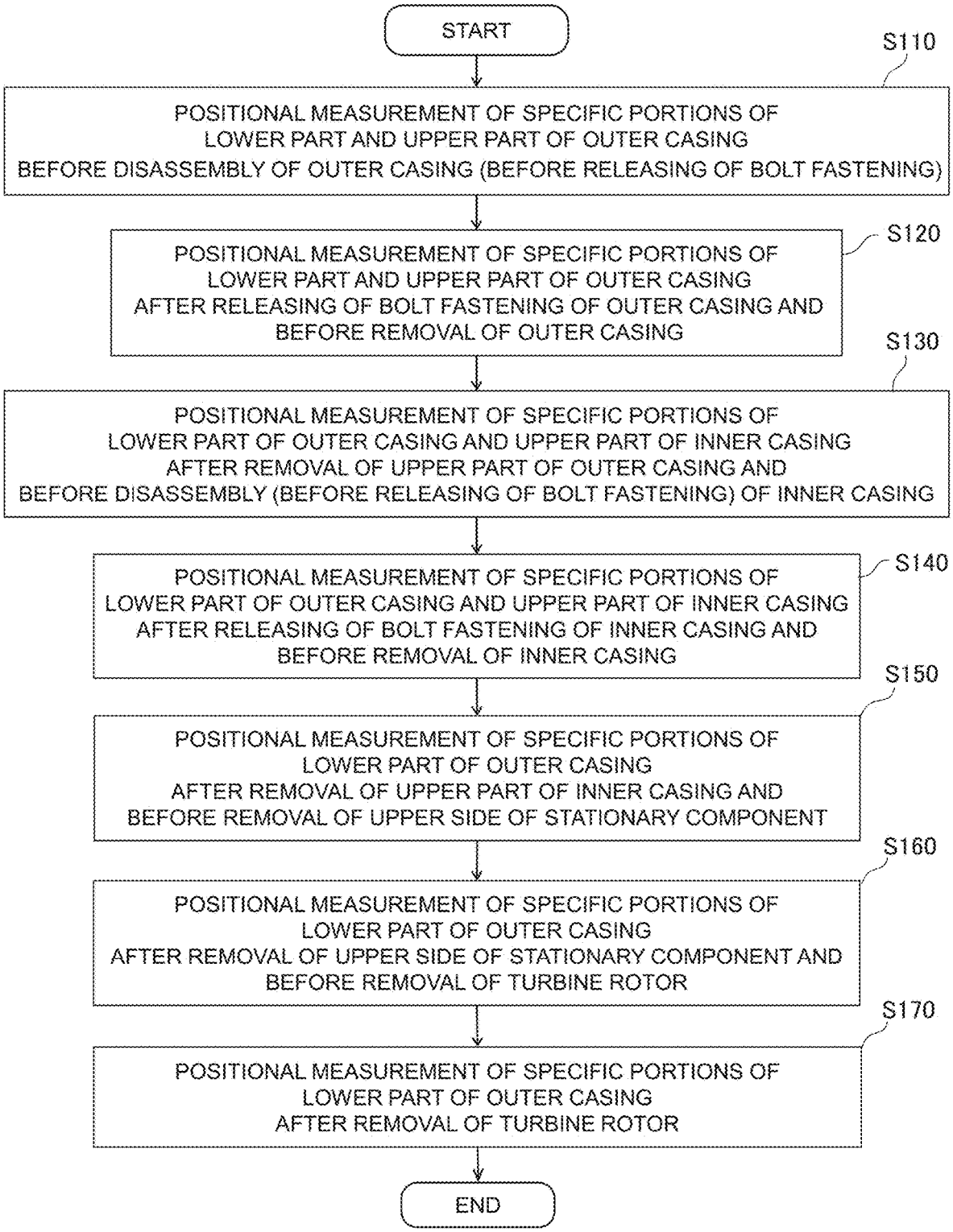
FIG. 8 is a flowchart illustrating a method of measuring positional information of the casing at turbine disassembly in the turbine assembly method according to the first embodiment of the present invention.
Figure 9:
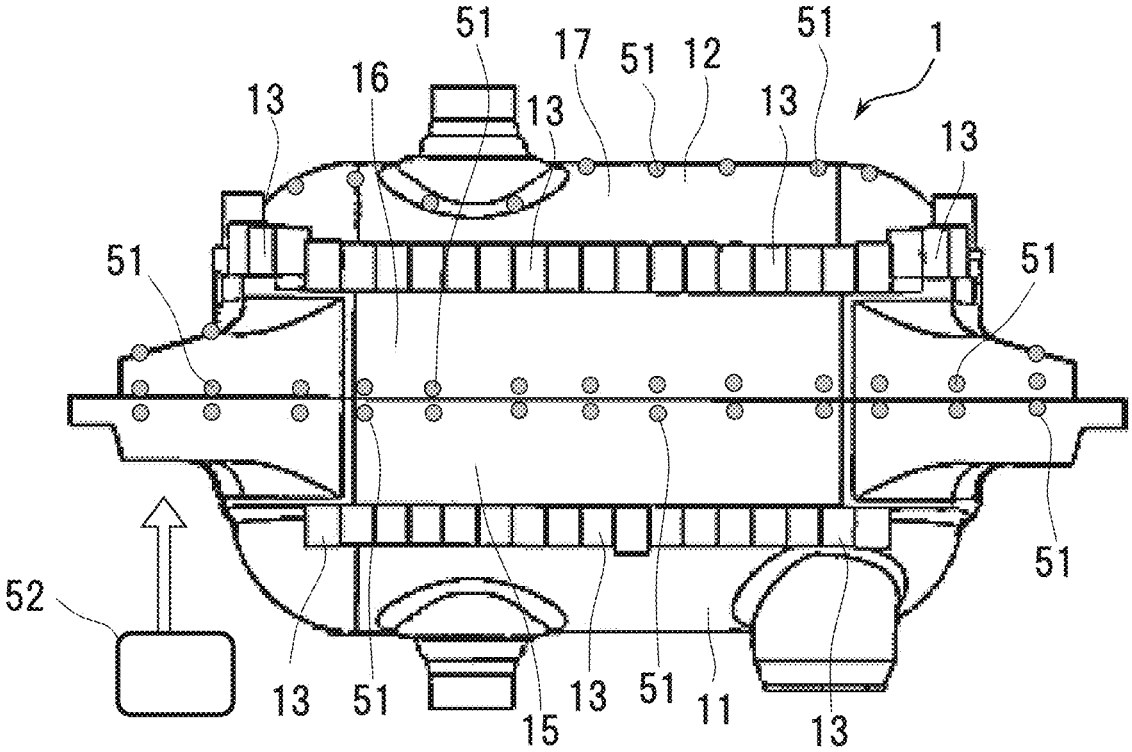
FIG. 9 is an explanatory view showing a method of measuring positional information before the releasing of the bolt fastening of the outer casing of the steam turbine (before the disassembly of the steam turbine) in the turbine assembly method according to the first embodiment of the present invention.
Figure 10:
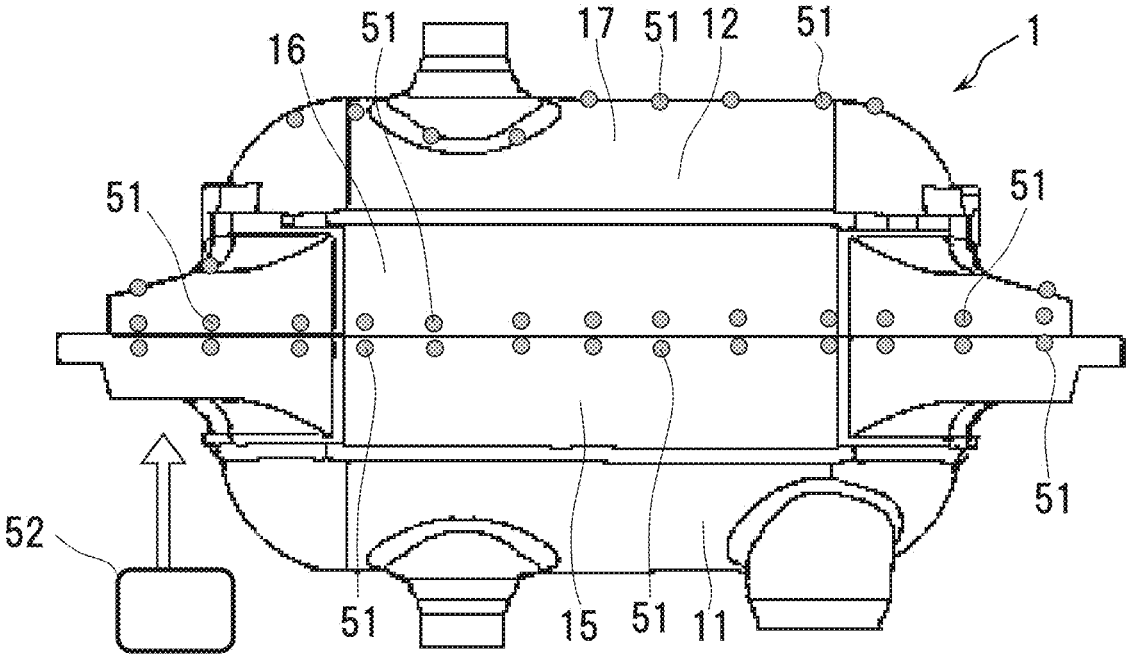
FIG. 10 is an explanatory view showing a method of measuring positional information after the releasing of the bolt fastening of the outer casing of the steam turbine and before the opening of the upper part of the outer casing in the turbine assembly method according to the first embodiment of the present invention.
Figure 11:
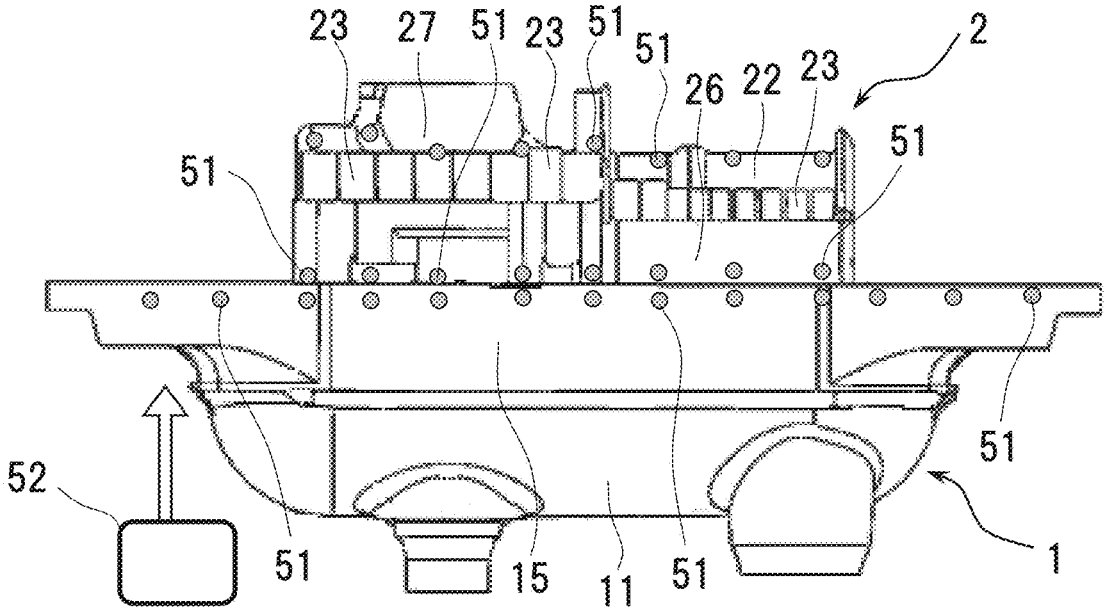
FIG. 11 is an explanatory view showing a method of measuring positional information after the opening of the upper part of the outer casing of the steam turbine and before the releasing of the bolt fastening of the inner casing in the turbine assembly method according to the first embodiment of the present invention.
Figure 12:
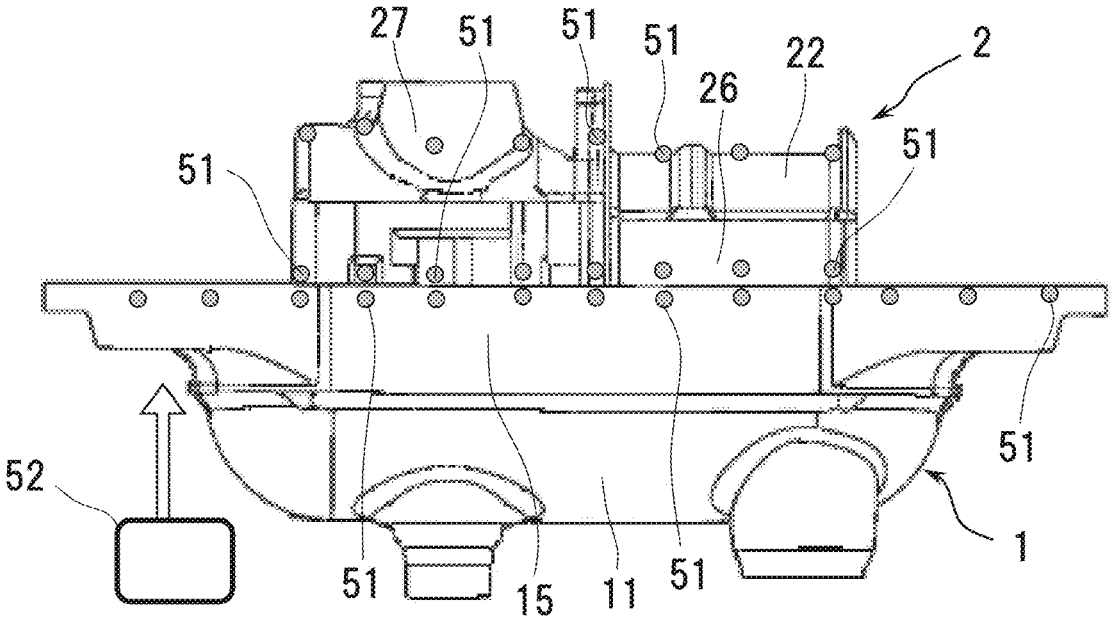
FIG. 12 is an explanatory view showing a method of measuring positional information after the releasing of the bolt fastening of the inner casing of the steam turbine and before the opening of the upper part of the inner casing in the turbine assembly method according to the first embodiment of the present invention.
Figure 13:
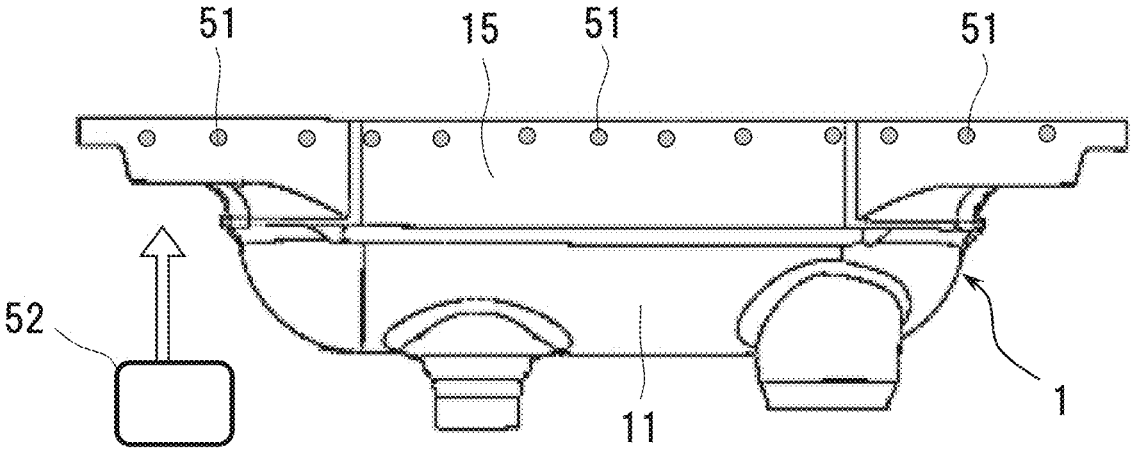
FIG. 13 is an explanatory view showing a method of measuring positional information after the opening of the upper side (tops-off state) of the steam turbine in the turbine assembly method according to the first embodiment of the present invention.

FIG. 8 is a flowchart illustrating a method of measuring positional information of the casing at turbine disassembly in the turbine assembly method according to the first embodiment of the present invention, FIG. 9 is an explanatory view showing a method of measuring positional information before the releasing of the bolt fastening of the outer casing of the steam turbine (before the disassembly of the steam turbine) in the turbine assembly method according to the first embodiment of the present invention, FIG. 10 is an explanatory view showing a method of measuring positional information after the releasing of the bolt fastening of the outer casing of the steam turbine and before the opening of the upper part of the outer casing in the turbine assembly method according to the first embodiment of the present invention, FIG. 11 is an explanatory view showing a method of measuring positional information after the opening of the upper part of the outer casing of the steam turbine and before the releasing of the bolt fastening of the inner casing in the turbine assembly method according to the first embodiment of the present invention, FIG. 12 is an explanatory view showing a method of measuring positional information after the releasing of the bolt fastening of the inner casing of the steam turbine and before the opening of the upper part of the inner casing in the turbine assembly method according to the first embodiment of the present invention, and FIG. 13 is an explanatory view showing a method of measuring positional information after the opening of the upper side (tops-off state) of the steam turbine in the turbine assembly method according to the first embodiment of the present invention. In FIGS. 8 through 13, the components that are the same as those of FIGS. 1 through 7 are indicated by the same reference characters, and a detailed description thereof will be left out.

In FIG. 8, before the disassembly of the outer casing 1 of the steam turbine, that is, before the releasing of the bolt fastening of the outer casing 1, positional information on a plurality of specific portions 51 set on the outer surface of the outer casing 1 is measured (step S110). More specifically, as shown in FIG. 9, mirrors as measurement markers are installed on the plurality of specific portions 51 (the filled circle portions as shown in FIG. 9) on the outer surfaces of the lower part 11 and the upper part 12 of the outer casing 1. A laser beam is applied to these mirrors from, for example, a laser measuring instrument 52, and the reflection from the markers is received, whereby the three-dimensional positional coordinates of the markers are located (measured). In this laser measurement, it is possible to use both a method in which solely the coordinates of one point in the region with respect to each portion to be measured are measured and a method in which the entire region is scanned (automatic multi-point measurement).

The specific portions 51 of the outer casing lower part 11 are set at positions of the outer surface in the vicinity of the portions supporting the inner casing 2 on the inner side of the outer casing 1 (the inner casing support portions). That is, the positions of the outer surface are portions where displacement is expected to be generated corresponding to the displacement of the inner casing support portions when the outer casing 1 is deformed. More specifically, on both side surfaces in the vicinity of the flange surface of the flange portion 15 of the outer casing lower part (in the vicinity of bolt joint portion), the specific portions 51 (in FIG. 9, 13 positions on one side) are set at intervals in the longitudinal direction of the flange portions 15 (the axial direction of the turbine rotor 3).

The specific portions 51 of the outer casing upper part 12 are set at positions of the outer surface in the vicinity of the inner casing support portions, and are located almost immediately above the specific portions 51 of the outer casing lower part 11. Like the specific portions 51 of the lower part 11, the positions of the outer surface are portions where displacement corresponding to the displacement of the inner casing support portions is expected to be generated when the outer casing 1 is deformed. More specifically, on both side surfaces in the vicinity of the flange surface of the flange portion 16 of the outer casing upper part 12 (in the vicinity of bolt joint portion), the specific portions 51 (16 positions on one side in FIG. 9) are set at intervals in the longitudinal direction of the flange portion 16 (the axial direction of the turbine rotor 3). Further, a plurality of (nine in FIG. 9) specific portions 51 of the outer casing upper part 12 are set at positions in the vicinity of the top portion 17 of the outer surface. The positions in the axial direction of the turbine rotor 3 of the specific portions 51 in the vicinity of the top portion 17 correspond to the positions of the specific portions 51 set on the flange portion 16. In the outer surface of the outer casing 1, the region in the vicinity of the top portion 17 is one of the regions which involve a large displacement amount at the deformation of the outer casing 1. Thus, even in the case where the displacement amount of the inner casing support portions on the inner side of the outer casing 1 is small, it is easy for the specific portions 51 in the vicinity of the top portion 17 to seize the displacement of the inner casing support portions.

As shown in FIG. 10, after the measurement in step S110, the bolt fastening of the outer casing 1 is released, and the bolts 13 (see FIG. 9) are removed. In this state, that is, after the releasing of the bolt fastening of the outer casing 1 and before the removal of the outer casing upper part 12, the positional information on the specific portions 51 on the outer surface of the lower part 11 and the upper part 12 of the outer casing 1 is measured (step S120). The positional information measurement method is the same as that executed in step S110, which also applies to the subsequent steps.

From the measurement result in step S120 and the measurement result in step S110, it is possible to obtain displacement information such as the displacement amount and displacement direction of the outer surface of the outer casing 1 due to the releasing of the bolt fastening of the outer casing 1. When the bolt fastening of the outer casing 1 is released, the flange portions 15 and 16 of the outer casing 1 deforms, for example, into a wavelike shape (see FIG. 4), and the cylindrical shape of the cross-section of the outer casing 1 is distorted (see FIG. 5). At this time, deformation (displacement) in the longitudinal direction and the vertical direction of the flange portions 15 and 16 is evaluated by the displacement information on the plurality of specific portions 51 of the flange portions 15 and 16 of the lower part 11 and the upper part 12 of the outer casing 1 (see FIGS. 4 and 10). Further, the distortion (roundness) of the cylindrical shape of the outer casing 1 is evaluated by the displacement information in the vertical direction and the horizontal direction of the plurality of specific portions 51 at the flange portion 16 of the outer casing upper part 12 and the plurality of specific portions 51 at the top portion 17 (see FIGS. 5 and 10).

The specific portions 51 on the outer surface of the outer casing 1 are portions where displacement corresponding to the displacement of the inner casing support portions on the inner side of the outer casing 1 is expected to be generated, so that it is possible to evaluate the displacement information on the inner casing support portions due to the releasing of the bolt fastening of the outer casing 1 based on the displacement information on these specific portions 51. The specific portions 51 in the vicinity of the top portion 17 of the outer casing 1 are more likely to seize the displacement of the inner casing support portions than the specific portions 51 of the flange portions 15 and 16, so that, even in the case where errors are included in the measurement results of the positional information on the specific portions 51 of the flange portions 15 and 16, by referring to the measurement result of the specific portions 51 in the vicinity of the top portion 17, it is possible to more accurately evaluate the displacement information on the inner casing support portions. The displacement information on the inner casing support portions is obtained based on the actually measured data at the disassembly of the outer casing 1, so that, as compared with the case where estimation is made by a predetermined model, the displacement information obtained is of higher accuracy and reliability.

As shown in FIG. 11, after the measurement in step S120, the upper part 12 of the outer casing 1 (see FIG. 10) is removed from the lower part 11. In this state, that is, after the removal of the outer casing upper part 12 and before the releasing of the bolt fastening of the inner casing 2, positional information on the above-mentioned specific portions 51 on the outer surface of the outer casing lower part 11 and a plurality of specific portions 51 set on the outer surface of the inner casing upper part 22 is measured (step S130).

The specific portions 51 of the inner casing upper part 22 are set at positions on the outer surface in the vicinity of the portions supporting the stationary components such as the nozzle diaphragms 6 (stationary component support portions). That is, the positions on the outer surface are portions where displacement is expected to be generated corresponding to the displacement of the stationary component support portions at the deformation of the inner casing 2. More specifically, on both side surfaces in the vicinity of the flange surface of the flange portion 26 of the inner casing upper part 22 (in the vicinity of the bolt-connected portion), the specific portions 51 (8 positions on one side in FIG. 11) are set at intervals in the longitudinal direction of the flange portion 26 (the axial direction of the turbine rotor 3). Further, the specific portions 51 (eight in FIG. 11) of the inner casing upper part 22 are set at positions in the vicinity of the top portion 27 of the outer surface. The positions in the axial direction of the turbine rotor 3 of the specific portions 51 in the vicinity of the top portion 27 correspond to the positions of the specific portions 51 set on the flange portion 26. In the outer surface of the inner casing 2, the region in the vicinity of the top portion 27 is one of the regions which involves a large displacement amount at the deformation of the inner casing 2. Thus, even in the case where the displacement amount of the stationary component support portions on the inner side of the inner casing 2 is small, it is easy for the specific portions 51 in the vicinity of the top portion 27 to seize the displacement of the stationary component support portions on the inner side of the inner casing 2.

From the measurement results in this step S130 and the measurement results in the above step S120, it is possible to obtain displacement information such as the displacement amount and displacement direction of the specific portions 51 on the outer surface of the outer casing lower part 11 due to the load of the outer casing upper part 12. Based on the displacement information on the outer surface of the outer casing lower part 11, it is possible to evaluate the displacement information of the inner casing support portions due to the load of the outer casing upper part 12.

As shown in FIG. 12, after the measurement in step S130, the bolt fastening of the inner casing 2 is released, and the bolts 23 (see FIG. 11) are removed. In this state, that is, after the releasing of the bolt fastening of the inner casing 2 and before the removal of the inner casing upper part 22, the positional information on the specific portions 51 on the outer surface of the outer casing lower part 11 and the inner casing upper part 22 is measured (step S140).

From the measurement results of this step S140 and the measurement results of the above step S130, it is possible to obtain displacement information such as the displacement amount and displacement direction of the outer surface of the inner casing 2 due to the releasing of the bolt fastening of the inner casing 2. More specifically, by the displacement information on the plurality of specific portions 51 of the flange portion 26 of the inner casing upper part 22, the deformation (displacement) in the longitudinal direction and the vertical direction of the flange portion 26 of the inner casing 2 is evaluated. By the displacement information in the vertical direction and the horizontal direction of the plurality of specific portions 51 of the flange portion 26 and the plurality of specific portions 51 in the vicinity of the top portion 27, the distortion (roundness) of the cylindrical shape of the inner casing 2 is evaluated.

The specific portions 51 on the outer surface of the inner casing 2 are portions where displacement corresponding to the displacement of the stationary component support portions on the inner side of the inner casing 2 is expected to be generated, so that it is possible to evaluate the displacement information on the stationary component support portions due to the releasing of the bolt fastening of the inner casing 2 based on the displacement information on these specific portions 51. The specific portions 51 in the vicinity of the top portion 27 of the inner casing 2 are more likely to seize the displacement of the stationary component support portions than the specific portions 51 of the flange portion 26, so that, even in the case where errors are included in the measurement result of the positional information on the specific portions 51 of the flange portion 26, by referring to the measurement results of the specific portions 51 in the vicinity of the top portion 27, it is possible to more accurately evaluate the displacement information on the stationary component support portions. The displacement information on the stationary component support portions is obtained based on the actually measured data at the disassembly of the inner casing 2, so that, as compared with the case where estimation is made by a predetermined model, the displacement information obtained is of higher accuracy and reliability.

After the measurement in step S140, the inner casing upper part 22 is removed from the inner casing lower part 21 (not shown). In this state, that is, after the removal of the inner casing upper part 22 and before the removal of the upper side of the stationary components, positional information on the above-mentioned specific portions 51 on the outer surface of the outer casing lower part 11 is measured (step S150). From the measurement results in this step S150 and the measurement results in the above step S140, it is possible to obtain displacement information such as the displacement amount and displacement direction of the outer surface of the outer casing lower part 11 due to the load of the inner casing upper part 22. Based on the displacement information of the outer surface of the outer casing lower part 11, it is possible to evaluate the displacement information on the inner casing support portions due to the load of the inner casing upper part 22.

After the measurement in step S150, the upper side of the stationary components is removed from the inner casing lower part 21 (not shown). In this state, that is, after the removal of the upper side of the stationary component and before the removal of the turbine rotor 3 (see FIG. 2), positional information on the above-mentioned specific portions 51 on the outer surface of the outer casing lower part 11 is measured (step S160). From the measurement results in this step S160 and the measurement results in the above step S150, it is possible to obtain displacement information such as the displacement amount and displacement direction of the outer surface of the outer casing lower part 11 due to the load of the upper side of the stationary components. Based on the displacement information of the outer surface of the outer casing lower part 11, it is possible to evaluate the displacement information on the inner casing support portions due to the load of the upper side of the stationary components.

As shown in FIG. 13, after the measurement in step S160, the turbine rotor 3 is removed from the inner casing lower part 21 to attain a state in which the upper side of the steam turbine is open (tops-off state). In this state, positional information on the specific portions 51 of the outer surface of the outer casing lower part 11 is measured (step S170), and the measurement of the positional information on the specific portions 51 is completed.

From the measurement results in this step S170 and the measurement results in the first step S110, it is possible to obtain the displacement information on the outer surface of the outer casing lower part 11 before and after the disassembly of the outer casing 1 and the inner casing 2. Based on the displacement information on the outer surface of the outer casing lower part 11, it is possible to evaluate the displacement information on the inner casing support portions due to the assembly of the outer casing 1 and the inner casing 2.

Next, an alignment method in the turbine assembly method according to the first embodiment of the present invention will be described in detail with reference to FIGS. 7 through 13.

In step S40 of the flowchart shown in FIG. 7, positional adjustment of the stationary components such as the nozzle diaphragms 6 with respect to the inner casing lower part 21 (primary alignment) is conducted. At this time, the adjustment amount of the alignment is evaluated based on the measurement results in step S10 and the measurements result in step S30. That is, it is possible to reflect the influence of the deformation at the assembly of the outer casing 1 and the inner casing 2 in the adjustment amount of the alignment on the basis of the measurement results in step S10 (steps S110 through S170 of the flowchart shown in FIG. 8). Further, based on the measurement results in step S30, it is possible to reflect the influence of the deformation at the assembly of the stationary components such as the nozzle diaphragms 6 in the adjustment amount of the alignment.

More specifically, in order to reflect the influence of the deformation before and after the assembly of the outer casing 1, based on the positional information on the specific portions 51 of the outer casing lower part 11 measured in step S110 and step S170, displacement information on the portions supporting the inner casing 2 inside the outer casing 1 (the inner casing support portions) before and after the assembly of the outer casing 1 is evaluated. The displacement information is used to estimate how the inner casing 2 supporting the stationary components is displaced due to the assembly of the outer casing 1.

Further, in order to reflect the influence of the deformation before and after the assembly of the inner casing 2, the displacement information on the portions supporting the stationary components inside the inner casing 2 (stationary component support portions) before and after the assembly of the inner casing 2 is evaluated based on the positional information on the specific portions 51 on the outer surface of the inner casing upper part 22 measured in step S130 and step S140. Strictly, the displacement information is used to estimate how the stationary components are displaced due to the bolt fastening of the inner casing 2. That is, the displacement information reflects the influence of the deformation due to the bolt fastening of the inner casing 2, and does not reflect the influence of the deformation due to the final assembly of the inner casing 2. However, most of the displacement due to the assembly of the inner casing 2 is due to the bolt fastening of the inner casing 2. Accordingly, the above-mentioned displacement information can be regarded as equivalent to the displacement information before and after the assembly of the inner casing 2.

Further, in order to reflect the influence of the deformation before and after the assembly of the nozzle diaphragms 6, the displacement information before and after the assembly of the nozzle diaphragms 6 is evaluated based on the information on the positional relationship of the nozzle diaphragms 6 before and after the temporary assembly of the nozzle diaphragms 6 measured in step S30.

In this way, in step S40, the displacement information of the inner casing support portions reflecting the influence of the deformation before and after the assembly of the outer casing 1, the displacement information on the stationary component supporting portions reflecting the influence of the deformation before and after the assembly of the inner casing 2, and the displacement information of the stationary components reflecting the influence of the deformation before and after the assembly are all taken into consideration, whereby it is possible to obtain the displacement information before and after the assembly of the steam turbine. The adjustment amount of the alignment is evaluated based on the displacement information. That is, the thickness of the position adjustment members (not shown) such as shims is adjusted such that the lower side of the stationary components is situated with respect to the inner casing lower part 21 so as to preliminarily offset the displacement information of the stationary components due to the assembly of the steam turbine.

As described above, in the steam turbine after long-term operation, a complicated and unpredictable deformation is often generated in the outer casing 1 and the inner casing 2. In such a steam turbine, it is difficult to predict deformation of the outer casing 1 and the inner casing 2 by utilizing model simulation or the like. In generally, in its assembly, it is difficult to secure desired clearances without temporary assembly of the outer casing 1 and the inner casing 2 (simulating the actual assembly state).

In contrast, in the present embodiment, the positional information on the specific portions 51 of the outer casing 1 and the inner casing 2 is measured at the disassembly of the steam turbine, whereby the deformation information at the assembly of the outer casing 1 and the inner casing 2 is estimated. The stationary components are aligned based on the deformation information. That is, the deformation information on the casing of the steam turbine which is hard to predict through simulation or the like is obtained from the actual measurement data at the disassembly. Thus, without the temporary assembly of the outer casing 1 and the inner casing 2, it is possible to align with an accuracy equivalent to that in the case where their temporary assembly is performed, and to secure the desired clearances.

Further, in the present embodiment, in order to align the stationary components taking into consideration the influence of the deformation at the assembly of the outer casing 1, there is used the displacement information on the specific portions 51 of the outer casing lower part 11 based on the measurement results in step S110 and step S170 of the flowchart shown in FIG. 8. The displacement information reflects the influence of the deformation due to the state difference before and after the disassembly of the outer casing 1. Thus, it is possible to align taking into consideration the deformation in the state in which the outer casing 1 is finally assembled, and a highly accurate adjustment can be maintained.

In a first modification of the present embodiment, in order to align the stationary components taking into consideration the influence of the deformation at the assembly of the outer casing 1, it is also possible to use displacement information on the specific portions 51 of the lower part 11 and the upper part 12 based on the measurement results in step S110 and step S120. The displacement information does not strictly reflect the influence of the deformation before and after the assembly of the outer casing 1 but reflects solely the influence of the deformation before and after the bolt fastening releasing of the outer casing 1. The deformation before and after the assembly of the outer casing 1 is generated due to the load of the stationary components, the turbine rotor 3, the outer casing upper part 12, and the inner casing upper part 22, etc. and due to the bolt fastening of the outer casing 1. Most of the deformation of the outer casing 1, however, is due to the bolt fastening of the outer casing 1. Thus, even in the case where there is used the measurement results of the positional information on the specific portions 51 of the outer casing 1 in the state before the bolt fastening releasing of the outer casing 1 and in the state after the bolt fastening releasing and before the removal of the outer casing upper part 12, it is possible to adjust with an accuracy equivalent to that of the alignment reflecting the influence of the deformation before and after the assembly of the outer casing 1.

In the first embodiment, there is used the displacement information on the specific portions 51 of solely the outer casing lower part 11, whereas, in this first modification, in addition to the displacement information on the specific portions 51 of the outer casing lower part 11, it is also possible to use the displacement information on the specific portions 51 of the upper part 12. The displacement information on the specific portions 51 of the outer casing upper part 12 includes the displacement information on the specific portions 51 in the vicinity of the top portion 17, so that it allows evaluation of the distortion (roundness) of the cylindrical shape of the cross section of the outer casing 1. Further, the specific portions 51 in the vicinity of the top portion 17 are more likely to seize the displacement of the inner casing support portions inside the outer casing 1 than the specific portions 51 of the lower part 11. Thus, by further taking into consideration the displacement information of the specific portions 51 of the outer casing upper part 12 at the alignment of the stationary components, it is possible to more accurately evaluate the influence of the deformation of the outer casing 1.

In a second modification of the first embodiment, in order to align the stationary components taking into consideration the influence of the deformation at the assembly of the outer casing 1, it is also possible to use the displacement information on the specific portions 51 of the outer casing 1 based on the measurement results in step S110, step S120, and step S170. In this case, there are used both the displacement information on the specific portions 51 of the outer casing lower part 11 based on the measurement results in step S110 and step S170 and the displacement information on the specific portions 51 of the lower part 11 and the upper part 12 of the outer casing 1 based on the measurement results in step S110 and step S120. As in the first embodiment, the former displacement information reflects the influence of the deformation before and after the assembly of the outer casing 1. Meanwhile, as in the first modification, the latter displacement information reflects the influence of the deformation before and after the bolt fastening of the outer casing 1, and it allows evaluation of the distortion (roundness) of the cylindrical shape of the cross section of the outer casing 1. Thus, in this second modification, both kinds of displacement information are taken into consideration at the alignment of the stationary components, whereby, as compared with the first embodiment and the first modification thereof, it is possible to more accurately evaluate the influence of the deformation at the assembly of the outer casing 1.

Further, in a third modification of the first embodiment, in order to align the stationary components taking into consideration the influence of the deformation at the assembly of the outer casing 1, it is also possible to use the displacement information on the specific portions 51 of the outer casing lower part 11 based on the measurement results in step S110 and step S130, or, step S110 and step S140. As compared with the first modification, this displacement information further reflects the influence of the deformation of the outer casing 1 due to the load of the outer casing upper part 12. In this third modification, through the measurement of the positional information in step S110, step S130, and step S140, it is possible to align the stationary components taking into consideration the influences of the deformation at the assembly of the outer casing 1 and the deformation at the assembly of the inner casing 2. Meanwhile, in the first embodiment, to take into consideration both influences of the deformation at the assembly of the outer casing 1 and the deformation at the assembly of the inner casing 2, it is necessary to measure positional information at least in step S110, step S130, step S140, and step S170. In the first modification, it is necessary to measure positional information in step S110, step S120, step S130, and step S140. In the second modification, it is necessary to measure positional information in step S110, step S120, step S130, step S140, and step S170. That is, as compared with the first embodiment and the first or second modification thereof, the third modification can achieve a reduction in the measurement processes of the positional information.

Further, in a fourth modification of the first embodiment, in order to align the stationary components taking into consideration the influence of the deformation at the assembly of the outer casing 1, it is also possible to use the displacement information on the specific portions 51 of the outer casing lower part 11 based on the measurement results in step S110 and step S150. As compared with the third modification, the displacement information further reflects the influence of the deformation of the outer casing 1 due to the load of the inner casing upper part 22. Thus, in the fourth modification, as compared with the third modification, the influence of the deformation at the assembly of the outer casing 1 can be more accurately evaluated in the alignment of the stationary components.

Further, in a fifth modification of the first embodiment, in order to align the stationary components taking into consideration the influence of the deformation at the assembly of the outer casing 1, it is also possible to use the displacement information on the specific portions 51 of the outer casing lower part 11 based on the measurement result in step S110 and step S160. As compared with the fourth modification, the displacement information further reflects the influence of the deformation of the outer casing 1 due to the load of the upper side of the stationary components. Thus, in the fifth modification, as compared with the fourth modification, the influence of the deformation at the assembly of the outer casing 1 can be more accurately evaluated in the alignment of the stationary components.

In the above description, the combination of the measurement of the positional information on the specific portions 51 of the outer casing 1 in step S110 and the measurement of the positional information on the specific portions 51 of the outer casing 1 in at least one of steps S120 through S170 constitutes a first measurement process. Further, the measurement of the positional information on the specific portions 51 of the inner casing 2 in step S130 and the measurement of the positional information on the specific portions 51 of the inner casing 2 in step S140 constitute a second measurement process.

As described above, in accordance with the turbine assembly method according to the first embodiment of the present invention, positional information on the specific portions 51 of the outer surface of the outer casing 1 and the inner casing 2 (the casing) is measured in a predetermined disassembly state at the disassembly of the steam turbine (turbine), and the positional adjustment of the stationary components such as the nozzle diaphragms 6 with respect to the inner casing 2 (the casing) is conducted based on the measurement result. Accordingly, it is possible to maintain the requisite accuracy in the positional adjustment of the stationary components without the temporary assembly of the outer casing 1 and the inner casing 2 (the casing). Thus, it is possible to shorten the process and time of the steam turbine (turbine) assembly operation. As a result, it is possible to start the commercial operation of the steam turbine (turbine) early, and to achieve a reduction in the cost of the assembly operation.

Further, according to the present embodiment, the specific portions 51 of the lower part 11 and the upper part 12 of the outer casing 1 are set to positions on the outer surface in the vicinity of the portions supporting the inner casing 2 on the inner side of the outer casing 1 (the inner casing support portions), so that it is possible to estimate with high accuracy the displacement of the inner casing support portions at the assembly of the outer casing 1 based on the measurement results of the positional information on the specific portions 51 of the outer casing 1.

Further, according to the present embodiment, the specific portions 51 of the upper part 22 of the inner casing 2 are set to positions on the outer surface in the vicinity of the portions supporting the stationary components on the inner side of the inner casing 2 (the stationary component supporting portions), so that it is possible to estimate with high accuracy the displacement of the stationary component supporting portions at the assembly of the inner casing 2 based on the measurement results of the positional information on the specific portions 51 of the inner casing 2.

Further, according to the present embodiment, the specific portions 51 are set on the both side surfaces of the outer casing 1 and the inner casing 2, so that it is possible to obtain displacement information on the both sides of the outer casing 1 and the inner casing 2. Thus, even in the case where an asymmetrical deformation is generated on the both sides of the outer casing 1 and the inner casing 2, it is possible to maintain high accuracy for the alignment of the stationary components using the measurement results of the positional information on the specific portions 51 on the both side surfaces.

Second Embodiment

Figure 14:
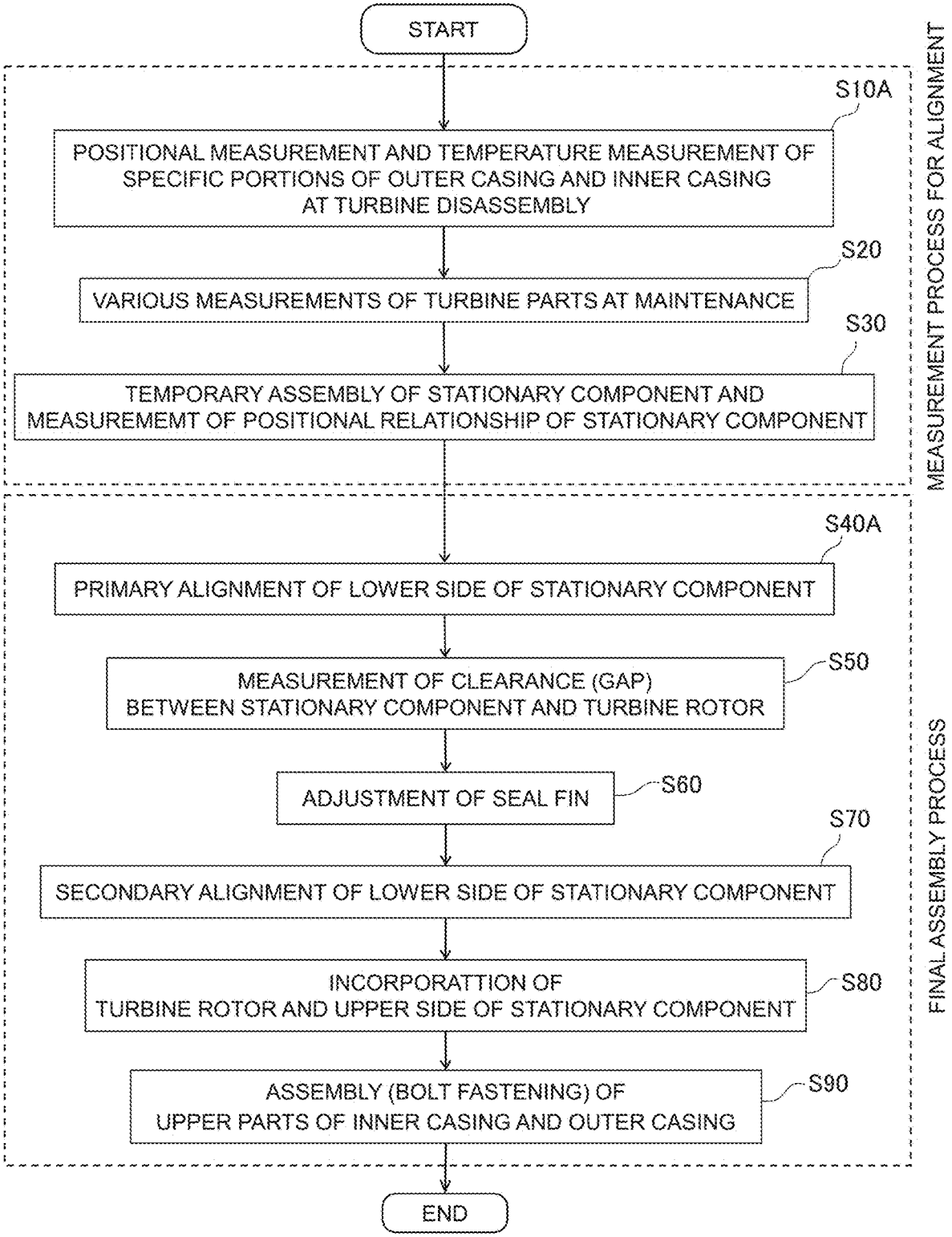
FIG. 14 is a flowchart showing a turbine assembly method according to a second embodiment of the present invention.

Next, a turbine assembly method according to a second embodiment of the present invention will be described with reference to FIG. 14. FIG. 14 is a flowchart showing the turbine assembly method according to the second embodiment of the present invention. In FIG. 14, the components that are the same as those of FIG. 7 are indicated by the same reference characters, and a detailed description thereof will be left out.

In the turbine assembly method according to the second embodiment of the present invention, in addition to the measurement of the positional information on the specific portions 51 of the outer casing 1 and the inner casing 2 at the disassembly of the steam turbine in the first embodiment, the temperature of the specific portions 51 is also measured. For the purpose of shortening the work period, disassembly process of a high pressure casing and an intermediate pressure casing of a steam turbine is often started from a state in which casing temperature is high. In this case, it is to be expected that the three-dimensional positional coordinates of the specific portions 51 are changed every moment due to the influence of the thermal expansion of the casing. On the other hand, the casing assembly process is conducted in a certain state in which the casing temperature is lower than that at the disassembly. Thus, the influence of the difference in temperature between the disassembly process and the assembly process of the casing is evaluated, and is reflected in the adjustment amount of the alignment, whereby it is possible to perform an adjustment of still higher accuracy.

More specifically, as shown in FIG. 14, for each step of the disassembly states of each part of the steam turbine, the positional information on the specific portions 51 on the outer surface of the outer casing 1 and the inner casing 2 is measured, and at the same time the temperature of the specific portions 51 is measured (step S10A). Each step of the above disassembly states of each part of the steam turbine corresponds to each step of the disassembly state in the flowchart shown in FIG. 8. In the flowchart illustrating the method of measuring the specific portions 51 at the disassembly of the steam turbine in the present embodiment, the "positional measurement" of the steps (steps S110 through S170) of the flowchart shown in FIG. 8 is replaced by "positional measurement and temperature measurement."

In the temperature measurement, for example, a radiation thermometer may be used. In this case, it is possible to measure the temperature easily, in a non-contact fashion, and with relatively high accuracy. Apart from the radiation thermometer, various other temperature measuring instruments may be used so long as they allow the temperature measurement of the specific portions 51.

The measurement results in step S10A is used at the primary alignment (step S40A) of the lower side of the stationary components. More specifically, based on the measured positional information on the specific portions 51 of the outer casing 1 and the inner casing 2, there are obtained displacement information on the portions supporting the inner casing 2 in the outer casing 1 (inner casing supporting portions) and displacement information on the portions supporting the stationary components in the inner casing 2 (stationary component supporting portions). With respect to the displacement information of the inner casing supporting portions and the displacement information of the stationary component supporting portions, the influence of the difference between the temperature of the specific portions 51 at the disassembly measured simultaneously with the measurement of the positional information and the temperature at the assembly, for example, the room temperature of the work site is evaluated, whereby displacement information on the inner casing supporting portions and displacement information on the stationary component supporting portions corresponding to the temperature at the assembly are estimated. Based on the displacement information corresponding to the temperature at the assembly and the displacement information on the stationary components obtained in step S30, the final adjustment amount of the alignment is obtained. As an example of the method of estimating the displacement information corresponding to the temperature at the assembly, it is possible to previously obtain the relationship between the temperature distribution and the thermal expansion difference of the casing through FEM analysis or the like, and to use the analysis result.

The other steps (steps S20 through S30, and steps S50 through S90) are the same as those of the first embodiment, and a description thereof will be left out.

As described above, as in the first embodiment, according to the turbine assembly method according to the second embodiment of the present invention, positional information on the specific portions 51 of the outer surface of the outer casing 1 and the inner casing 2 is measured in a predetermined disassembly state at the disassembly of the steam turbine, and the positions of the stationary components with respect to the inner casing 2 are adjusted based on the measurement result. Thus, it is possible to maintain the requisite accuracy in the positional adjustment of the stationary components without the temporary assembly of the outer casing 1 and the inner casing 2.

Further, according to the present embodiment, at the disassembly of the outer casing 1 and the inner casing 2, also the temperature of the specific portions 51, the positional information of which is measured, is measured, and the stationary components are aligned reflecting the temperature measurement results. Accordingly, as compared with the first embodiment, it is possible to conduct an alignment of higher accuracy.

Other Embodiments

The present invention is not restricted to the above-described embodiments but includes various modifications. While the above embodiments have been described in detail in order to facilitate the understanding of the present invention, the present invention is not always restricted to a construction equipped with all the components described above. For example, a part of the construction of an embodiment may be replaced by the construction of another embodiment. Further, to the construction of an embodiment, the construction of another embodiment may be added. Further, with respect to a part of the construction of each embodiment, it is possible to effect addition, deletion, and replacement of some other construction.

For example, while in the first and second embodiments and the modifications thereof described above the turbine assembly method of the present invention is applied to an assembly method of a steam turbine, the present invention is also applicable to an assembly method of a turbine constituting a part of a gas turbine. That is, the present invention is applicable to an assembly method of various kinds of turbine involving generation of casing deformation due to the influence of heat after years of operation such as a steam turbine and a turbine constituting a part of a gas turbine.

Further, in the above-described embodiments and the modifications thereof the turbine assembly method of the present invention is applied to an assembly method of a steam turbine having a configuration in which the nozzle diaphragms 6 are supported by the inner casing 2. The present invention is also applicable to an assembly method of a steam turbine having a configuration in which a stationary blade ring (stationary component) as an assembly, in which a plurality of stationary blade rows are fixed to annular members, is supported by the inner casing 2.

While in the above embodiments and the modifications thereof the turbine assembly method of the present invention is applied to an assembly method of a steam turbine having a configuration in which the load of the turbine rotor 3 is supported by the foundation 100, the present invention is also applicable to an assembly method of a steam turbine having a configuration in which the turbine rotor 3 is supported by the outer casing 1 and the inner casing 2. In this case, by taking into consideration the deformation of the outer casing 1 and the inner casing 2 due to the load of the turbine rotor 3, it is possible to conduct an adjustment of high accuracy.

In the assembly methods shown in the above embodiments and the modifications thereof, when performing the primary alignment of the stationary components in steps S40 and S40A, the measurement results of the information on the positional relationship before and after the temporary assembly of the stationary components in step S30 is taken into consideration. In the alignment of the stationary components in steps S40 and S40A, in order to secure the desired clearances, it is necessary to make an adjustment in which the final assembly state is supposed. When the deformation information of solely the outer casing 1 and the inner casing 2 at the assembly is taken into consideration as the final assembly state, there is a fear of the desired clearances not being secured due to the deformation of the stationary components such as the nozzle diaphragms 6 at the assembly thereof. In view of this, the deformation information of the stationary components before and after the temporary assembly thereof obtained based on the measurement in step S30 is taken into consideration, whereby the influence of the deformation of the stationary components at the assembly is reflected in the alignment. This assembly method is suitable for a case where the stationary components are greatly deformed at the assembly.

However, in the case where the stationary components are replaced by new ones, in the case where the joint surfaces of the upper side and the lower side of the stationary components are repaired to be flat, or in the case where the deformation of the stationary components is minute, the influence due to the deformation of the stationary components at the assembly thereof is negligible. Thus, no problem is involved even if the final assembly state is estimated taking into consideration the deformation information of solely the outer casing 1 and the inner casing 2 at the assembly. Thus, it is also possible to omit the process of step S30 and to align the stationary components taking into consideration solely the measurement results in step S10 without obtaining the measurement results before and after the temporary assembly of the stationary components. In this case, there is no need to perform the temporary assembly of the stationary components and the measurement process (step S30), so that, as compared with the first and second embodiments and the modifications thereof, it is possible to further shorten the process and time of the steam turbine assembly operation.

In the above embodiments and the modifications thereof, for each step of the disassembly states of the parts (the outer casing 1, the inner casing 2, the stationary components, etc.) of the steam turbine, the positional information on the specific portions 51 of the outer casing 1 and the inner casing 2 is measured (steps S110 through S170). It is also possible, however, to adopt a method in which solely the positional information to be used at the alignment of the stationary components is measured. For example, in the first embodiment, of the seven processes of steps S110 through S170, it is only necessary to perform the measurement in the four processes: step S110, step S130, step S140, and step S170. In the first modification, it is only necessary to perform the measurement in the four processes: step S110, step S120, step S130, and step S140. In the third modification, it is only necessary to perform the measurement in the three processes: step S110, step S130, and step S140. This also applies to the second, fourth, and fifth modifications.

Further, while in the above-described embodiments the specific portions 51 are set on the both side surfaces of the outer casing 1 and the inner casing 2, it is also possible to set the specific portions 51 on one side surfaces of the outer casing 1 and the inner casing 2. In this case, the displacement information on the other side surfaces is estimated based on the displacement information of the specific portions 51 on the one side surfaces, whereby the alignment of the stationary components is conducted. In the latter case, the accuracy in the alignment is degraded as compared with the case where the alignment is conducted based on the displacement information on the specific portions 51 on the both side surfaces. However, the measurement regions of the specific portions 51 are diminished, so that the measurement of the specific portions 51 is facilitated.

In the above-described embodiments and the modifications thereof, the turbine assembly methods of the present invention are applied to a steam turbine having a double casing structure of the outer casing 1 and the inner casing 2. The present invention is also applicable to a turbine (steam turbine) having a single casing. The turbine includes a casing supported by a foundation 100, and a turbine rotor 3 contained in the casing. Stationary components such as the nozzle diaphragms 6 are arranged inside the casing, and the portions supporting the stationary components (stationary component supporting portions) are provided on the inner side of the casing.

In the assembly method of the turbine having a single casing, for example, the "outer casing and the inner casing" in steps S10, S10A, and S90 in FIG. 7 and FIG. 14 are replaced by the "casing." Further, regarding the details on the measurement of the positional information of the specific portions of the casing at the disassembly of the turbine in step S10, the flowchart shown in FIG. 8 is revised as follows. The "outer casing" in steps S110 and S120 is replaced by the "casing," and steps S130 and S140 are deleted. The "inner casing" and the "outer casing" in step S150 are replaced by the "casing," and the "outer casing" in steps S160 and S170 is replaced by the "casing."

As the alignment method in this case, for example, the positional adjustment of the stationary components with respect to the casing is conducted based on the positional information on the specific portions of the casing lower part measured in the state before the releasing of the bolt fastening of the casing at the disassembly of the turbine, and in the state in which the casing upper part, the upper side of the stationary components, and the turbine rotor 3 are removed, that is, in the open state of the turbine upper side (tops-off state). In this case, it is possible to align taking into consideration the deformation of the casing in the state in which the turbine is finally assembled, so that it is possible to maintain an adjustment of high accuracy.

Further, it is also possible to align the stationary components based on the positional information on the specific portions of the lower part and the upper part of the casing measured in the state before the releasing of the bolt fastening of the casing, and in the disassembly state after the releasing of the bolt fastening and before the removal of the casing upper part. In this case, based on the displacement information of the specific portions of the casing upper part, it is possible to evaluate the distortion (roundness) of the cylindrical shape of the cross section of the casing, so that it is possible to evaluate the influence of the casing deformation more accurately.

Further, it is also possible to align the stationary components based on the measurement result of the positional information on the specific portions of the lower part and the upper part of the casing in the state before the releasing of the bolt fastening of the casing, in the disassembly state after the releasing of the bolt fastening and before the removal of the casing upper part, and in the state in which the upper side of the turbine is open. In this case, it is possible to take into consideration the casing deformation in the final assembly state of the turbine, and to evaluate the distortion (roundness) of the cylindrical shape of the cross section of the casing, so that it is possible to maintain an alignment of higher accuracy.

In this way, even in the case where the turbine assembly method of the present invention is applied to a turbine having a single casing, as in the case of the first and second embodiments and the modifications thereof, positional information on the specific portions on the outer surface of the casing is measured in a predetermined disassembly state at the disassembly of the turbine, and positional adjustment of the stationary components with respect to the casing is conducted based on the measurement results. Accordingly, it is possible to maintain the requisite accuracy in the positional adjustment of the stationary components without temporary assembly of the casing.

What is claimed is:

1. A method of assembling a turbine including a casing divided into a casing lower part and a casing upper part, a turbine rotor contained in the casing, and a stationary component supported inside the casing and divided into a lower side and an upper side, the casing lower part and the casing upper part being connected together by bolt fastening, the method comprising:

a positional information measurement process in which positional information on a plurality of specific portions set on an outer surface of the casing is measured in a state before releasing of bolt fastening of the casing at a time of disassembly of the turbine and in a predetermined disassembly state after the releasing of the bolt fastening;

an alignment process in which positional adjustment of the stationary component with respect to the casing is made based on measurement results in the positional information measurement process; and a casing assembly process in which the casing lower part and the casing upper part are fastened together by bolts, wherein the casing includes:

an outer casing divided into an outer casing lower part and an outer casing upper part, the outer casing lower part and the outer casing upper part being connected together by bolt fastening; and an inner casing divided into an inner casing lower part and an inner casing upper part, the inner casing lower part and the inner casing upper part being connected together by bolt fastening, the inner casing supporting the stationary component therewithin, the inner casing being contained and supported within the outer casing, the positional information measurement process includes:

a first measurement process in which positional information on a plurality of specific portions set on an outer surface of the outer casing is measured in a state before releasing of the bolt fastening of the outer casing and in a predetermined disassembly state after the releasing of the bolt fastening; and a second measurement process in which positional information on a plurality of specific portions set on an outer surface of the inner casing upper part is measured in a state before releasing of the bolt fastening of the inner casing and in a disassembly state after the releasing of the bolt fastening of the inner casing and before removal of the inner casing upper part, the alignment process is a process in which positional adjustment of the stationary component with respect to the inner casing is made based on measurement results in the first measurement process and in the second measurement process, and the casing assembly process includes:

an inner casing assembly process in which the inner casing lower part and the inner casing upper part are fasten together by bolts; and an outer casing assembly process in which the outer casing lower part and the outer casing upper part are fasten together by bolts.

2. The method of assembling the turbine according to claim 1, wherein the predetermined disassembly state after the releasing of the bolt fastening of the outer casing in the first measurement process is a state in which the outer casing upper part, the inner casing upper part, the upper side of the stationary component, and the turbine rotor are removed, and the specific portions of the outer casing are set on the outer casing lower part.

3. The method of assembling the turbine according to claim 1, wherein the predetermined disassembly state after the releasing of the bolt fastening of the outer casing in the first measurement process is a state before removal of the outer casing upper part.

4. The method of assembling the turbine according to claim 1, wherein the predetermined disassembly state after the releasing of the bolt fastening of the outer casing in the first measurement process includes both a state before removal of the outer casing upper part and a state in which the outer casing upper part, the inner casing upper part, the upper side of the stationary component, and the turbine rotor are removed, and the specific portions of the outer casing are set on both the outer casing lower part and the outer casing upper part.

5. The method of assembling the turbine according to claim 1, wherein the plurality of specific portions are set on the outer surface in the vicinity of portions supporting the stationary component in the casing.

6. The method of assembling the turbine according to claim 5, wherein the plurality of specific portions are set on at least one of both side surfaces of the casing at intervals in the axial direction of the turbine rotor.

7. The method of assembling the turbine according to claim 6, wherein the plurality of specific portions are set on the both side surfaces of the casing.

8. The method of assembling the turbine according to claim 7, wherein the plurality of specific portions are further set in the vicinity of a top portion of the casing upper part.

9. The method of assembling the turbine according to claim 1, further comprising a temperature measurement process in which the temperature of the plurality of specific portions is also measured when the positional information measurement process is executed, wherein the alignment process is a process in which the positional adjustment of the stationary component is made further taking into consideration measurement results in the temperature measurement process.

10. The method of assembling the turbine according to claim 1, wherein the measurement of the positional information in the positional information measurement process is conducted by using a laser measuring instrument.

11. The method of assembling the turbine according to claim 1, further comprising:

a temporary assembly process in which temporary assembly of at least the stationary component is conducted; and a temporary assembly state measurement process in which information on a positional relationship of the stationary component in the temporary assembly state is measured, wherein the alignment process is a process in which the positional adjustment of the stationary component is made further taking into consideration a measurement result in the temporary assembly state measurement process.

* * * * *